US006776097B2

(12) United States Patent
Takeda

(10) Patent No.: US 6,776,097 B2
(45) Date of Patent: Aug. 17, 2004

(54) PLATE SUPPLYING APPARATUS

(75) Inventor: Morihiro Takeda, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/674,511

(22) Filed: Oct. 1, 2003

(65) Prior Publication Data

US 2004/0065221 A1 Apr. 8, 2004

(30) Foreign Application Priority Data

Oct. 2, 2002 (JP) ..... 2002-290166
Oct. 2, 2002 (JP) ..... 2002-290167

(51) Int. Cl.[7] ..... B65H 3/08

(52) U.S. Cl. ..... 101/477; 101/389.1; 271/9.08; 271/106

(58) Field of Search ..... 101/477, 480, 101/389.1; 271/9.08, 11, 105, 106

(56) References Cited

U.S. PATENT DOCUMENTS 6,341,932 B1 1/2002 Otsuji
6,675,712 B2 * 1/2004 Marincic et al. ..... 101/477
6,718,875 B2 * 4/2004 Ono ..... 101/477
2002/0157554 A1 * 10/2002 Koizumi et al. ..... 101/477

FOREIGN PATENT DOCUMENTS

JP 2000-247489 9/2000

* cited by examiner

*Primary Examiner*—Andrew H. Hirshfeld
*Assistant Examiner*—Kevin D. Williams
(74) *Attorney, Agent, or Firm*—McDermott Will & Emery LLP

(57) ABSTRACT

In the plate supplying apparatus of the present invention, various vibrations are provided to a plate secured via suction during a separating operation by causing pad rods 403 to repeat a slight ascent and a pause, and thereafter causing the pad rods 403 to make an abrupt descent, thereby reliably peeling off a slip sheet adhering to the back face of the plate. Further, vibration in the rod-up/down direction is provided to the plate during the separating operation, and the plate is not pushed hard. Thus, it is possible to prevent the plate from being damaged. A raising and lowering motor 52 is driven to lower the cassette 9. A separating operation for peeling off a slip sheet S adhering to the back face of the plate P is performed, and thereafter the plate P secured via suction is turned over and transferred.

10 Claims, 27 Drawing Sheets

PLATE SUPPLYING APPARATUS

BACKGROUND OF THE INVENTION

1. Field of the Invention

The present invention relates to a plate supplying apparatus, and more particularly to a plate supplying apparatus for supplying a plate, which is transferred such that its faces are reversed, from a storage section in which a plurality of plates are piled such that each plate alternates with a slip sheet.

2. Related Art Statement

A conventional plate supplying apparatus automatically supplies a plate, such as a presensitized (PS) plate, to an image recording apparatus for irradiating that plate with a laser beam to directly record an image thereon. The plate used with such an image recording apparatus includes a support layer and an image recording layer. Since the image recording layer is easily damaged, the utmost caution is required when supplying the plate. In recent years, a variety of types of plates having a thickness between 0.15 millimeters (mm) and 0.50 mm have come into wide use.

The conventional plate supplying apparatus receives a cassette containing a plurality of plates each alternating with a slip sheet for preventing friction between plates. For example, Japanese Patent Laid-Open Publication No. 2000-247489 discloses a plate supplying apparatus which includes a movable arm or the like having plate suction cups. In the state where the plate suction cups secure a support layer side of a plate via suction, the movable arm moves the plate suction cups to a prescribed position, so that the plate is taken out from a cassette, and then supplied to an image recording apparatus as described above. Each time the movable arm or the like takes a plate out from the cassette, movable slip sheet suction cups secure a slip sheet via suction. In this state, the slip sheet suction cups move to a prescribed position, thereby ejecting the slip sheet from the conventional plate supplying apparatus.

Referring to FIGS. 23 to 26, an operation of the above-described conventional plate supplying apparatus will be described. FIGS. 23 to 26 are views used for explaining a series of operation of a plate transfer mechanism which is included in a plate supplying apparatus 200 and used for transferring plates P from a cassette 206 toward an image recording apparatus.

In FIGS. 23 to 26, the plates P to be supplied from the plate supplying apparatus 200 are stored in the cassette 206 such that an image recording layer of each plate P faces downwards. The plates Pare piled in the cassette 206 in a manner as described above, i.e., each plate P alternates with a slip sheet S. The plate transfer mechanism included in the plate supplying apparatus 200 transfers the plates P from the cassette 206 placed in a plate supply position to the image recording apparatus. The plate transfer mechanism includes a traveling member 204 which travels along a guide rail 210 by receiving drive from an endless synchronous belt 207 which is caused to move rotationally by drive of a motor 208 transmitted via a belt 209. The traveling member 204 has a coupling member 205 secured thereon. The coupling member 205 holds the synchronous belt 207 by sandwiching the synchronous belt 207 between two separate portions so as to receive the drive therefrom. The traveling member 204 also includes a speed reducer 203 having a pinion to be engaged with a rack rail 211 provided in parallel with the guide rail 210. The speed reducer 203 has an arm 202 secured on an output shaft thereof. The arm 202 has an end portion including a support board on which a plurality of suction pads 201 are provided for holding a plate P via suction. The plurality of suction pads 201 are provided so as to conform to the plates P stored in the cassette 206.

In the case where the plate transfer mechanism having the above-described structure is in the state illustrated in FIG. 23, when the traveling member 204 is driven by the motor 208 so as to move toward a direction to the right (hereinafter, referred to as the "transfer movement direction"), as illustrated in FIGS. 24–26, the arm 202 pivots on the center of the output shaft of the speed reducer 203 in a clockwise direction (hereinafter, referred to as the "transfer turn direction"). Therefore, in the case where the suction pads 201 hold a support layer side of a plate P via suction in the state illustrated in FIG. 23, and then, as illustrated in FIGS. 24–26, the traveling member 204 is driven by the motor 208 so as to move toward the transfer movement direction, when the arm 202 pivots 180° in the transfer turn direction, the plate P held via suction by the suction pads 201 is turned, such that the plate's faces are reversed (i.e., the support layer of the plate P faces downwards), while experiencing bending stress. Thereafter, as illustrated in FIG. 26, a leading end of the plate P will be sandwiched between a pair of transfer rollers 212 and 213 for transferring the plate P to the image recording apparatus.

In some cases, when the arm 202 transfers the plate P, a slip sheet S adhering to a back face of the plate P can also be transferred together depending on the type of the slip sheet S and an environmental condition such as static electricity. In order to solve such a problem, the plate supplying apparatus 200 disclosed in Japanese Patent Laid-Open Publication No. 2000-247489 performs, for example, a so-called separating operation during transfer of the plate P held via suction by the suction pads 201 by causing the plate P to stand still, or vibrate, for a prescribed period, thereby peeling off the slip sheet S adhering to the back face of the plate P.

Referring to FIG. 27, described next is an exemplary operation of peeling off the slip sheet S by swinging the arm 202 for a prescribed time period. FIG. 27 is a graph illustrating movements of the arm 202 swinging for a prescribed time period with respect to the speed of the traveling member 204 moving toward the transfer movement direction and the angle of the arm 202 in the transfer turn direction. In FIG. 27, the speed of the traveling member 204 moving from the position in FIG. 23 toward the transfer movement direction is indicated by a positive value, and the angle of the arm 202 in the transfer turn direction is indicated on the assumption that the arm 202 in the state of FIG. 23 is set at an angle of 0°.

In FIG. 27, when the arm 202 is placed at 0° in the transfer turn direction, a plate P is held via suction by the suction pads 201 (the state of FIG. 23). Then, the traveling member 204 moves toward the transfer movement direction until the arm 202 reaches an angle a. Thereafter, in a section from the angle a to an angle b, the traveling member 204 repeatedly makes a slight movement toward the transfer movement direction and a pause. When the arm 202 reaches the angle b, the traveling member 204 moves backwards in an anti-transfer movement direction until the arm 202 returns to the angle a. Then again, in the section from the angle a to the angle b, the traveling member 204 repeatedly makes a slight movement toward the transfer movement direction and a pause. The plate supplying apparatus 200 repeats the above-described operation a prescribed number of times, and thereafter transfers the plate P held via suction by the suction pads 201 toward the image recording apparatus in a manner as described above.

However, in such a conventional plate supplying apparatus 200 which is configured to peel off the slip sheet S adhering to the back face of the plate P by causing the plate P to stand still for a prescribed time period during transfer, the reliability of peeling off the slip sheet S is low. In some cases, the slip sheet S adhering to the back face of the plate P can be transferred together with the plate P.

In the above-described case of peeling off the slip sheet S adhering to the back face of the plate P by swinging the arm 202 for a prescribed time period, it is necessary to increase the angle bin order to reliably peel off the slip sheet S. For example, the separating operation is performed with settings of the angle a=10° and the angle b=40°. When the separating operation is performed with such angle settings, bending stress is generated by the stiffness of the plate P in accordance with the angle of the arm 202. The bending stress pushes the plate P toward the direction of the cassette 206. As described above, in the section from the angle a to the angle b, vibration is applied to the plate P. Accordingly, the pushing force due to the bending stress and the vibration are simultaneously applied to the plate P, and therefore, in some cases, friction is caused between pushed portions of the plate P, resulting in damage to an image recording layer of the plate P.

In recent years, there have been needs of plates having a large area and/or a large thickness, and simultaneous supply of a plurality of such plates, for example. In the case of using the conventional plate supplying apparatus 200 to transfer such plates having a large area and/or a large thickness, a large moment of force is applied to the arm 202. Therefore, a drive force of the motor 208 for driving the traveling member 204 is required to be increased, resulting in a cost increase.

Further, in the case of using the conventional plate supplying apparatus 200 to transfer the plate P, bending stress is applied to the plate P in a manner as described above, and therefore, a repulsive force is generated in a direction of causing the plate P to be detached from the suction pads 201. Such a repulsive force becomes larger with an increase of the thickness of the plate P. For example, in the case of transferring a plate P having a thickness of 0.4 mm, the repulsive force is large as compared to the suction force of the suction pads 201, and therefore, in some cases, the plate P can be dropped from the suction pads 201 during transfer.

In order to prevent such a drop of the plate P, it is conceivable to increase a pivoting radius of the suction pads 201 to reduce the repulsive force. In such a case, for example, the arm 202 is required to be lengthened, resulting in upsizing of the plate transfer mechanism. Moreover, the drive force of the motor 208 is required to be increased, leading to the upsizing and cost increase of the plate supplying apparatus 200.

In order to prevent the drop of the plate P, it is also conceivable to set the suction force of the suction pads 201 so as to exceed the repulsive force by increasing negative pressure supplied to the suction pads 201. However, in the case of using a large suction force, which has been set so as to exceed the repulsive force, in order to secure a plate P having a small thickness (e.g., 0.15 mm) via suction, the plate P having such a small thickness may be deformed by such a large suction force. Accordingly, it is necessary to control the negative pressure supplied to the suction pads 201 in accordance with the thickness of the plate P to be transferred. Thus, a mechanism for detecting the thickness of the plate P and a mechanism for controlling the negative pressure are required, leading to a cost increase of the plate supplying apparatus 200.

SUMMARY OF THE INVENTION

Therefore, an object of the present invention is to provide a plate supplying apparatus capable of preventing an image recording layer of a plate from being damaged when shaking a slip sheet off the plate.

Another object of the present invention is to provide a plate supplying apparatus capable of reducing a moment of force applied to an arm when transferring a plate, thereby reducing the cost of a motor for driving the arm.

Still another object of the present invention is to provide a plate supplying apparatus capable of supplying a plate of any thickness without increasing the size of the apparatus itself by reducing a repulsive force generated in the plate being transferred such that its faces are reversed, thereby preventing a drop of the plate during transfer.

Still another object of the present invention is to provide a plate supplying apparatus capable of successfully taking a plate from the top of a pile of plates stored in a cassette placed in a plate supply position, and supplying the plate such that its faces are reversed.

The present invention has the following features to attain the objects mentioned above.

A first aspect of the present invention is directed to a plate supplying apparatus for supplying a plate, which is transferred such that its faces are reversed, from a pile of plates each alternating with a slip sheet. The apparatus includes: a storage section for storing the pile of plates each alternating with the slip sheet; a plate suction section for sucking a proximal end portion of a plate present at the top of the pile of plates stored in the storage section, the proximal end portion being nearer to the plate suction section; a base member for supporting the plate suction section; a moving and pivoting mechanism for moving the plate suction section and the base member in a direction toward a portion of the plate opposite to the proximal end portion, while causing at least the plate suction section to pivot, thereby transferring the plate sucked by the plate suction section such that its faces are reversed; a vertical movement mechanism for causing the plate suction section to move up and down with respect to the base member; a control section for controlling movement of each of the plate suction section, the moving and pivoting mechanism, and the vertical movement mechanism; and a supplying section for supplying the plate transferred by the moving and pivoting mechanism toward another equipment device. The control section controls the plate suction section so as to suck the plate, and then controls the vertical movement mechanism so as to cause the plate suction section to move up and down, thereby performing a separating operation for shaking off a slip sheet adhering to a back face of the plate, and thereafter the control section controls the moving and pivoting mechanism so as to transfer toward the supplying section the plate on which the separating operation has been performed by the vertical movement mechanism.

In the plate supplying apparatus according to the first aspect, vibration in a vertical direction is applied to the plate sucked by the plate suction section in order to shake off a slip sheet from that plate, and therefore only slight bending stress is applied to the plate, so that the plate is not pushed hard toward the direction of the storage section. Thus, it is possible to prevent the plate from being damaged by friction.

The control section may control the plate suction section so as to suck the plate, and then may control the vertical movement mechanism so as to cause the plate suction section to repeat a slight ascent or descent and a pause, thereby shaking off the slip sheet adhering to the back face of the plate. In this case, in order to shake off the slip sheet from the plate sucked by the plate suction section, the plate suction section is caused to repeat a slight ascent or descent and a pause, thereby applying various vibrations to the plate. Thus, it is possible to reliably peel off the slip sheet adhering to the back face of the plate.

The control section may control the plate suction section so as to suck the plate, and then may control the moving and pivoting mechanism so as to cause the plate suction section and the base member to pivot a prescribed angle, and thereafter the control section may control the vertical movement mechanism so as to cause the plate suction section to move up and down, thereby shaking off the slip sheet adhering to the back face of the plate. In this case, the prescribed angle is formed between the plate sucked by the plate suction section and the pile of plates and slip sheets stored in the storage section, thereby improving the efficiency of peeling off the slip sheet adhering to the sucked plate. Thus, it is possible to prevent the peeled slip sheet from adhering to the plate again. Moreover, the position of another end of the plate opposite to an end portion at which the plate is sucked can be stabilized, and therefore it is possible to prevent friction between the sucked plate and another plate or slip sheet during the up and down movement of the plate suction section.

The control section may control the vertical movement mechanism so as to shorten a distance between the base member and a position at which the plate suction section sucks the plate, and then may control the moving and pivoting mechanism so as to cause the plate suction section and the base member to move while pivoting, thereby transferring the plate. In this case, a moment of force required for causing the plate suction section and the base member to pivot is reduced, whereby it is possible to reduce the capacity of the driving source for supplying the moment of force, resulting in cost reduction. Further, the control section may control the vertical movement mechanism so as to cause the plate suction section to further move up or down such that the proximal end of the plate, which has been transferred by the moving and pivoting mechanism such that its faces are reversed, is aligned with the supplying section. Accordingly, positional setting of the supplying section for supplying the plate to another equipment device can be previously made in accordance with an adjustable range of the vertical movement mechanism, and therefore it is possible to readily modify the plate supplying apparatus in accordance with the height of an apparatus located in the subsequent stage.

In one exemplary case, the control section may control the vertical movement mechanism so as to adjust, in accordance with a vertical position of the plate present at the top of the pile of plates stored in the storage section within the plate supplying apparatus, a distance between the base member and a position at which the plate suction section sucks the plate present at the top of the pile of plates, and after the adjustment of the distance, the control section controls the plate suction section so as to suck the proximal end portion of the plate present at the top of the pile of plates. In another exemplary case, the control section may control the vertical movement mechanism so as to adjust, in accordance with a remaining amount of the pile of plates stored in the storage section, a distance between the base member and a position at which the plate suction section sucks the plate present at the top of the pile of plates, and then the control section may control the plate suction section so as to suck the proximal end portion of the plate present at the top of the pile of plates. In either case, it is possible to appropriately suck the plate in accordance with the height or the remaining amount of plates stored in the storage section.

The storage section may store a plurality of piles of plates side-by-side, each plate alternating with a slip sheet, the plate supplying apparatus may include a plurality of plate suction sections each provided for a corresponding one of the piles of plates stored in the storage section, the plate supplying apparatus may include a plurality of vertical movement mechanisms each provided for a corresponding one of the plate suction sections. The control section may control each of the vertical movement mechanisms so as to adjust, in accordance with a remaining amount of each pile of plates stored in the storage section, a distance between the base member and a position at which each of the plate suction sections sucks a plate present at the top of a corresponding one of the piles of plates, and then the control section may control each of the plate suction sections so as to suck a proximal end portion, which is nearer to that plate suction section, of the plate present at the top of the corresponding one of the piles of plates. Thus, it is possible to appropriately suck the plates in accordance with the remaining amount of each of the piles of plates stored side-by-side in the storage section.

Specifically, the vertical movement mechanism includes: a rod having the plate suction section provided at an end portion thereof; and a rod expansion and contraction mechanism for moving the rod along a longitudinal direction of the rod with respect to the base member.

A second aspect of the present invention is directed to a plate supplying apparatus for supplying a plate, which is transferred such that its faces are reversed, from a pile of plates. The apparatus includes: a storage section for storing the pile of plates; a plate suction section for sucking a proximal end portion of a plate present at the top of the pile of plates stored in the storage section, the proximal end portion being nearer to the plate suction section; a base member for supporting the plate suction section; a moving and pivoting mechanism for moving the plate suction section and the base member in a direction toward a portion of the plate opposite to the proximal end portion, while causing at least the plate suction section to pivot, thereby transferring the plate sucked by the plate suction section such that its faces are reversed; a vertical movement mechanism for causing the plate suction section to move up and down with respect to the base member; a control section for controlling movement of each of the plate suction section, the moving and pivoting mechanism, and the vertical movement mechanism; and a supplying section for supplying the plate transferred by the moving and pivoting mechanism toward another equipment device. The control section controls the plate suction section so as to suck the plate, and then controls the vertical movement mechanism so as to cause the plate suction section to move up and down, thereby performing a separating operation for shaking off another plate adhering to a back face of the plate sucked by the plate suction section, and thereafter the control section controls the moving and pivoting mechanism so as to transfer toward the supplying section the plate on which the separating operation has been performed by the vertical movement mechanism.

In the plate supplying apparatus according to the second aspect, vibration in a vertical direction is applied to the plate sucked by the plate suction section in order to shake off another plate adhering thereto, and therefore only slight bending stress is applied to the plate, so that the plate is not pushed hard toward the direction of the storage section. Thus, it is possible to prevent the plate from being damaged by friction.

A third aspect of the present invention is directed to a plate supplying apparatus for supplying a plate which is transferred such that its faces are reversed, the plate being present at the top of a pile of plates. The apparatus includes: a storage section for storing the pile of plates; a raising and lowering mechanism for raising and lowering the storage section; a plate suction section for sucking a proximal end portion of the plate present at the top of the pile of plates stored in the storage section placed in a first position, the proximal end portion being nearer to the plate suction section; a moving and pivoting mechanism for moving the plate suction section in a direction toward a portion of the plate opposite to the proximal end portion, while causing at least the plate suction section to pivot, thereby transferring the plate sucked by the plate suction section such that its faces are reversed; a control section for controlling movement of each of the plate suction section, the raising and lowering mechanism, and the moving and pivoting mechanism; and a supplying section for supplying the plate transferred by the moving and pivoting mechanism toward another equipment device. The control section controls the raising and lowering mechanism so as to cause the storage section to move to the first position, and then controls the plate suction section so as to suck the plate, and thereafter the control section controls the raising and lowering mechanism so as to lower the storage section from the first position to a second position, and then controls the moving and pivoting mechanism so as to transfer the plate toward the supplying section, while keeping the storage section placed in the second position.

In the plate supplying apparatus according to the third aspect, when the moving and pivoting mechanism transfers the plate sucked by the plate suction section from the storage section, the raising and lowering mechanism lowers the storage section to the second position, and then supplies the plate to the supplying section such that the plate's faces are reversed. Accordingly, bending radius R of the plate when the plate supplying apparatus according to the third aspect transfers the plate is increased as the storage section moves down, and therefore bending stress applied to the plate is reduced, resulting in reduction of a repulsive force generated in a direction of causing the plate to be detached from the plate suction section. That is, reduction of the repulsive force is realized even when the plate is thick, and therefore it is possible to prevent a drop of the plate during transfer. Moreover, in the plate supplying apparatus of the third aspect, the second position in which the storage section is placed is set in accordance with the type or size of the plate to be transferred, and therefore it is possible to prevent a drop of the plate during transfer without increasing the size and cost of the apparatus and/or suction force of the plate suction section.

The control section may control the plate suction section so as to suck the plate, and then may control the moving and pivoting mechanism so as to cause the plate suction section to pivot a prescribed angle, and thereafter the control section may control the raising and lowering mechanism so as to lowering the storage section to the second position. Thus, it is possible to stabilize the position of another end of the plate opposite to an end portion at which the plate is sucked, and therefore it is possible to prevent the plate from moving to a direction in which friction is caused between the plate and another plate.

The storage section may store a pile of plates each alternating with a slip sheet. In this case, the control section controls the suction section so as to suck the plate, and then controls the raising and lowering mechanism so as to lower the storage section from the first position to the second position, and thereafter the control section controls the moving and pivoting mechanism to cause the plate suction section to move back and forth, while pivoting, thereby performing a separating operation for shaking off a slip sheet adhering to a back face of the plate, and to transfer to the supplying section the plate on which the separating operation has been performed. Accordingly, even in the case of the separating operation in which various vibrations are applied to the plate to be transferred in order to shake off a slip sheet adhering to the back face of the plate, the storage section is lowered to the second position for performing the separating operation, and therefore it is possible to prevent a drop of the plate during the separating operation.

A fourth aspect of the present invention is directed to a plate supplying apparatus for supplying a plate which is transferred such that its faces are reversed. The apparatus includes: a plurality of storage sections each provided for storing a pile of plates; a plate suction section for sucking a proximal end portion of a plate present at the top of the pile of plates stored in a storage section, the proximal end portion being nearer to the plate suction section; a base member for supporting the plate suction section; a moving and pivoting mechanism for moving the plate suction section and the base member in a direction toward a portion of the plate opposite to the proximal end portion, while causing at least the plate suction section to pivot, thereby transferring the plate sucked by the plate suction section such that its faces are reversed; a distance adjusting mechanism for adjusting a distance between the base member and the plate suction section; a supplying section for supplying the plate transferred by the moving and pivoting mechanism toward another equipment device, and a control section for controlling the plate suction section, the distance adjusting mechanism, and the moving and pivoting mechanism, wherein after the distance adjusting mechanism is controlled so as to move the plate suction section with respect to the base member to cause a portion of the plate suction section which sucks the plate to be in contact with the plate present at the top of the pile of plates stored in the storage section, the plate suction section is controlled so as to suck the proximal end portion of the plate present at the top of the pile of plates, and thereafter the moving and pivoting mechanism is controlled so as to transferring the plate to the supplying section while turning over the plate.

In the plate supplying apparatus according to the fourth aspect, a plate present at the top of a pile of plates stored in a storage section can be reliably secured via suction by the plate suction section regardless of the vertical position of the plate to be transferred, which varies due to, for example, a remaining amount of plates in the storage section or an error in a vertical position of the storage section within the plate supplying apparatus. Accordingly, the plate is not detached from the plate suction section when the moving and pivoting mechanism transfers the plate to the supplying section while turning over the plate. Thus, it is possible to reliably supply the plate.

The plate supplying apparatus may further include: a multicassette section for accommodating the plurality of storage sections stacked together in a vertical direction; and a sliding mechanism for horizontally moving a storage section selected from among the plurality of storage sections to a plate supply position below the moving and pivoting mechanism. In this case, the distance adjusting mechanism moves the plate suction section with respect to the base member so as to cause the plate suction section to be in contact with the plate present at the top of the pile of plates stored in the storage section. Specifically, the distance adjusting mechanism includes: a rod having the plate suction section provided at an end thereof; and a rod expansion and contraction mechanism for moving the rod along a longitudinal direction of the rod with respect to the base member.

These and other objects, features, aspects and advantages of the present invention will become more apparent from the following detailed description of the present invention when taken in conjunction with the accompanying drawings.

DESCRIPTION OF THE PREFERRED EMBODIMENTS (First Embodiment)

Figure 1:
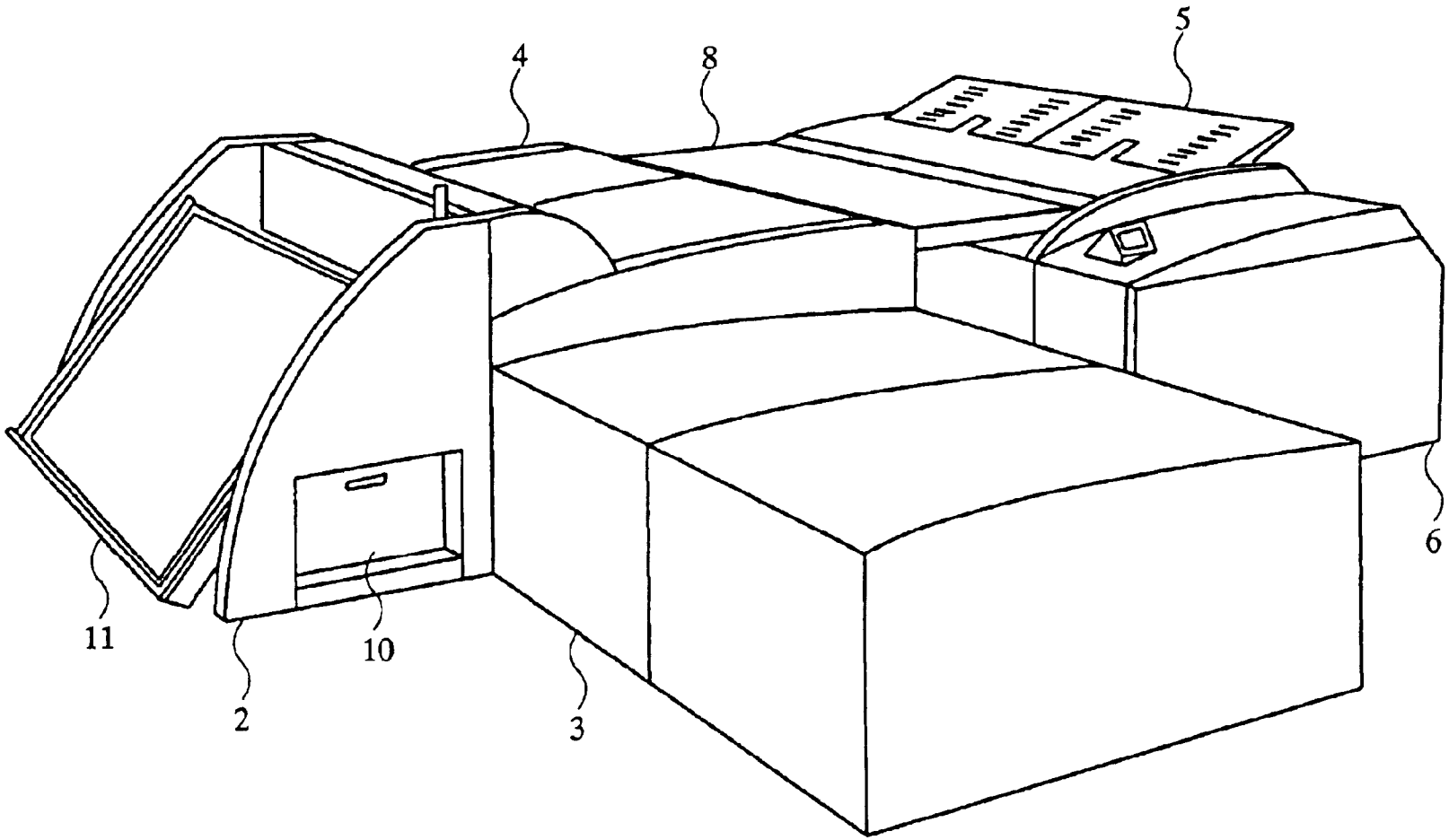
FIG. 1 is a perspective view of an image recording system including a plate supplying apparatus according to a first embodiment.
Figure 2:
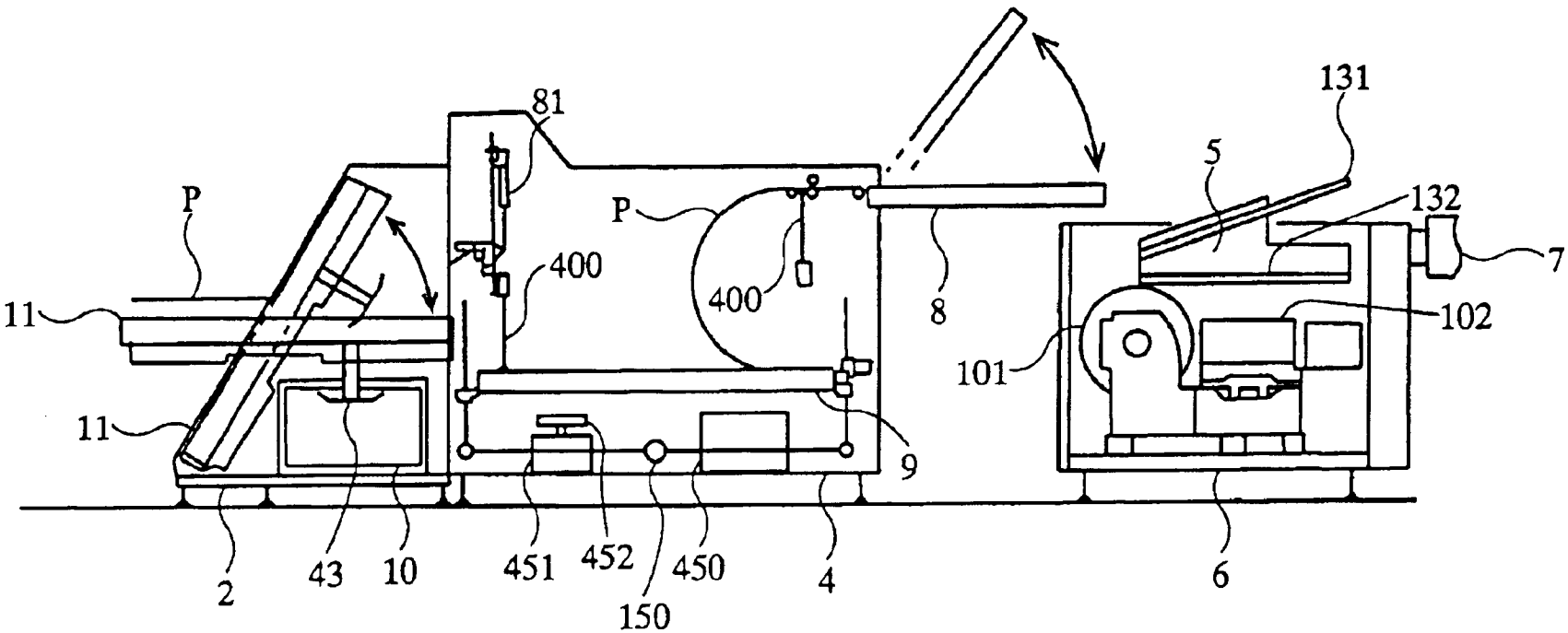
FIG. 2 is a schematic side view of the image recording system illustrated in FIG. 1.

A plate supplying apparatus according to a first embodiment of the present invention will be described below. FIG. 1 is a perspective view of an image recording system including the plate supplying apparatus according to the first embodiment. FIG. 2 is a schematic side view of the image recording system illustrated in FIG. 1.

In FIGS. 1 and 2, the image recording system includes: a plate supplying section 2 used for storing plates P into each of a plurality of cassettes 9; a multicassette section 3 accommodating the plurality of cassettes 9 stacked together in a vertical direction; a plate supplying apparatus 4 (hereinafter, referred to as the "autoloader section 4") for taking a plate P out from a cassette 9 having moved to a plate supply position and transferring that plate P; a feed and ejection tray section 5 having a plate feed tray 131 and a plate ejection tray 132; a conveyer section 8; an image recording section 6 for recording an image onto the plate P; and a transfer mechanism 7 for transferring the plate P on which the image has been recorded by the image recording section 6 to an automatic developing apparatus (not shown) located in the subsequent stage.

The conveyer section 8 is operable to transfer the plate P from the autoloader section 4 to the feed and ejection tray section 5. As indicated by a double-headed arrow in FIG. 2, the conveyer section 8 is configured to flip up on one end in order to increase the maintenance ability of the entire system.

As mentioned above, in this image recording system, the multicassette section 3 accommodates the plurality of cassettes 9 in a stacked manner. When plates P stored in one of the plurality of cassettes 9 are transferred to the image recording section 6, a slide mechanism (not shown) is used to move that one cassette 9 from the multicassette section 3 to the autoloader section 4. Then, a raising and lowering mechanism 150 controlled by an electronic section 450, which will be described later, raises or lowers the cassette 9 to a plate supply position illustrated in FIG. 2.

When storing new plates P into one of the plurality of cassettes 9 accommodated in the multicassette section 3, the sliding mechanism as mentioned above is used to move that one cassette 9 to the autoloader section 4. The raising and lowering mechanism 150 raise or lowers the cassette 9 to a cassette ejection position at the same level as that of a cassette holder 11 in a horizontal position illustrated in FIG. 2. Thereafter, the cassette 9 in the autoloader section 4 is caused to move along a guiding member (not shown) into the cassette holder 11 in the plate supplying section 2.

The cassette holder 11 is pivotably provided in the plate supplying section 2. As illustrated in FIG. 2, the cassette holder 11 is driven by a motor (not shown) so as to rock between a horizontal position and an inclined position. When the cassette 9 moves between the autoloader section 4 and the cassette holder 11, the cassette holder 11 is set in the horizontal position. Accordingly, when storing relatively small plates P into the cassette 9 having moved into the cassette holder 11, those small plates P can be stored without changing the horizontal position of the cassette holder 11. However, when storing relatively large plates P into the cassette 9, the cassette holder 11 is set in the inclined position, so that those large plates P can be readily stored into the cassette 9 without being bent. As described above, each plate P is a presensitized (PS) plate including a support layer and an image recording layer. The plates Pare stored into the cassette 9 such that their image recording layers face downwards, and each plate P alternates with a slip sheet for preventing frictions between plates.

Plates P to be transferred to the image recording section 6 by the autoloader section 4 are taken out from the cassette 9 placed in the plate supply position illustrated in FIG. 2. The autoloader section 4 includes: a plate transfer mechanism 400 having a plurality of movable arms each including plate suction pads which will be described later; a slip sheet transfer mechanism 81; a vacuum pump 451 connected via an electromagnetic valve 452 and a hose (not shown) so as to be in communication with suction pads of each of the plate transfer mechanism 400 and the slip sheet transfer mechanism 81; and the electronic section 450 for controlling all the above-mentioned elements included in the autoloader section 4. Each plate P contained in the cassette 9 placed in the plate supply position is held at its support layer side via suction by the suction pads of the plate transfer mechanism 400, and then reversed by causing the movable arm to move while pivoting. Thereafter, as illustrated in FIG. 2, the plate P is transferred toward the conveyer section 8. The plate P transferred to the conveyer section 8 is further transferred with its support layer facing downwards to the plate feed tray 131 of the feed and ejection tray section 5.

As described above, a plurality of plates P are piled in the cassette 9 such that each plate P alternates with a slip sheet. In order to eject the slip sheet, the autoloader section 4 includes the slip sheet transfer mechanism 81 having movable slip sheet suction pads. The slip sheet transfer mechanism 81 secures the slip sheet via suction by the slip sheet suction pads each time the movable arm of the plate transfer mechanism 400 takes the plate P out from the cassette 9. In the state where the slip sheet is secured via suction by the slip sheet suction pads, the slip sheet suction pads are caused to move to a prescribed position, thereby ejecting the slip sheet from the autoloader section 4 (i.e., the plate supplying apparatus) into a slip sheet container 10. Slip sheets ejected into the slip sheet container 10 are compressed by a slip sheet press 43 attached to the back face of the cassette holder 11 as illustrated in FIG. 2, so that a volume of the slip sheets in the slip sheet container 10 is reduced.

The image recording section 6 includes a cylindrical recording drum 101 and a recording head 102. The recording drum 101 is driven by a motor (not shown) so as to rotate about its cylindrical shaft, thereby carrying a plate P placed around the perimeter thereof. The recording head 102 is operable to record an image on the plate P placed around the perimeter of the recording drum 101. The recording head 102 includes a large number of light emitting devices for outputting optical beams obtained via modulation performed in accordance with an image signal or the like.

A plate P mounted on the feed tray 131 is transferred to the recording drum 101 provided in the image recording section 6. Then, the plate P is placed around the perimeter of the recording drum 101 with its image recording layer facing outwards, and then rotated about the cylindrical shaft of the recording drum 101. In this state, the recording head 102 irradiates the image recording layer of the plate P with the optical beams obtained via modulation performed in accordance with the image signal or the like. Thereafter, the plate P on which an image has been recorded is ejected via the plate ejection tray 132 into the transfer mechanism 7.

Figure 3A:
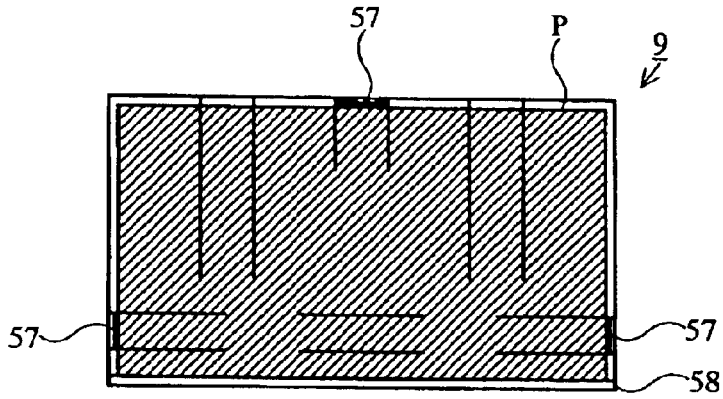
FIGS. 3A to 3C are views illustrating states where plates P of various sizes are stored in a cassette 9 illustrated in FIG. 2.
Figure 3B:
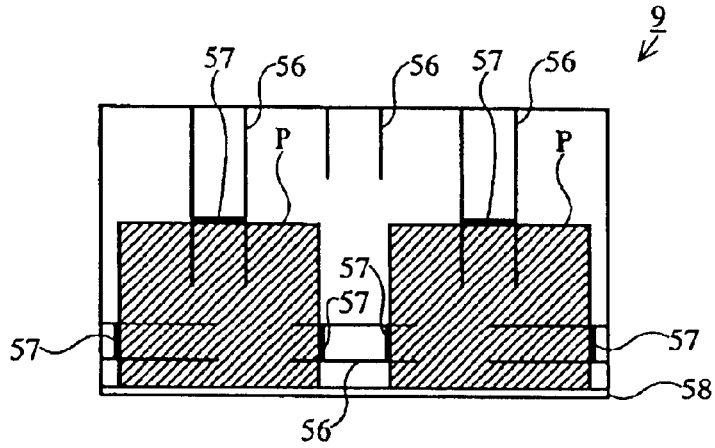
Figure 3C:
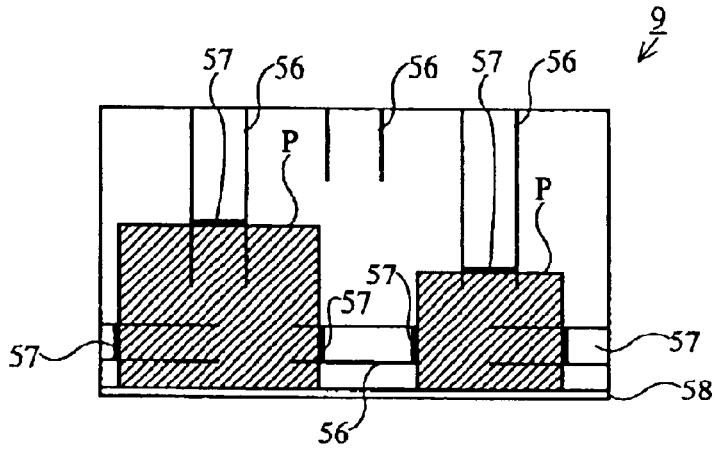

Referring to FIGS. 3A to 3C, a structure of the cassette 9 will now be described. FIGS. 3A to 3C are views illustrating states where plates P of various sizes are stored in the cassette 9.

In each of FIGS. 3A to 3C, a reference guide board 58, which is used as a positional reference of plates P of any sizes, is provided as a front wall of the cassette 9 (illustrated in a bottom direction of FIGS. 3A to 3C). In order to store a plurality of plates P of various sizes side-by-side in the cassette 9, a plurality of grooves 56 for attaching positioning members 57 used for positioning the plurality of plates P of various sizes are formed in a bottom face of the cassette 9. For example, in the case of storing a relatively large plate P in the cassette 9 as illustrated in FIG. 3A, that plate P is placed with one end along the reference guide board 58 and the other ends (in top, right, and left directions of FIG. 3A) along the positioning members 57 attached in the grooves 56. Alternatively, in the case of storing two plates P having the same size in the cassette 9 as illustrated in FIG. 3B, the two plates P are placed with one end along the reference guide board 58 and the other ends along the positioning members 57 attached in the grooves 56. Alternatively still, in the case of storing two plates P having different sizes in the cassette 9 as illustrated in FIG. 3C, the two plates P are placed with one end along the reference guide board 58 and the other ends along the positioning members 57 attached in the grooves 56. In this manner, in any one of the above cases, each plate P stored in the cassette 9 is positioned with one end contacting the reference guide board 58 and the other three ends contacting the positioning members 57 attached in the grooves 56.

Referring to FIGS. 4 to 7, described next are a schematic structure and a transfer operation of the plate transfer mechanism 400 for transferring plates P from the cassette 9 placed in the plate supply position toward the conveyer section 8. FIGS. 4 to 7 are views used for explaining the overall operation of the plate transfer mechanism 400 viewed from a side direction of the autoloader section 4. Note that the plate transfer mechanism 400 has a pair of structures in order to transfer two plates P stored side-by-side as described above. In the following description of the plate transfer mechanism 400, "a" is added to each end of reference numerals of elements included in one of the pair of structures (i.e., the structure on the side shown in FIG. 2), and "b" is added to each end of reference numerals of elements included in the other one of the pair of structures (i.e., a structure which can be seen from the side opposite to the side shown in FIG. 2). Elements having the same function and similarly operated in the pair of structures may be generically denoted by the same reference numerals without "a" or "b" added thereto.

Figure 4:
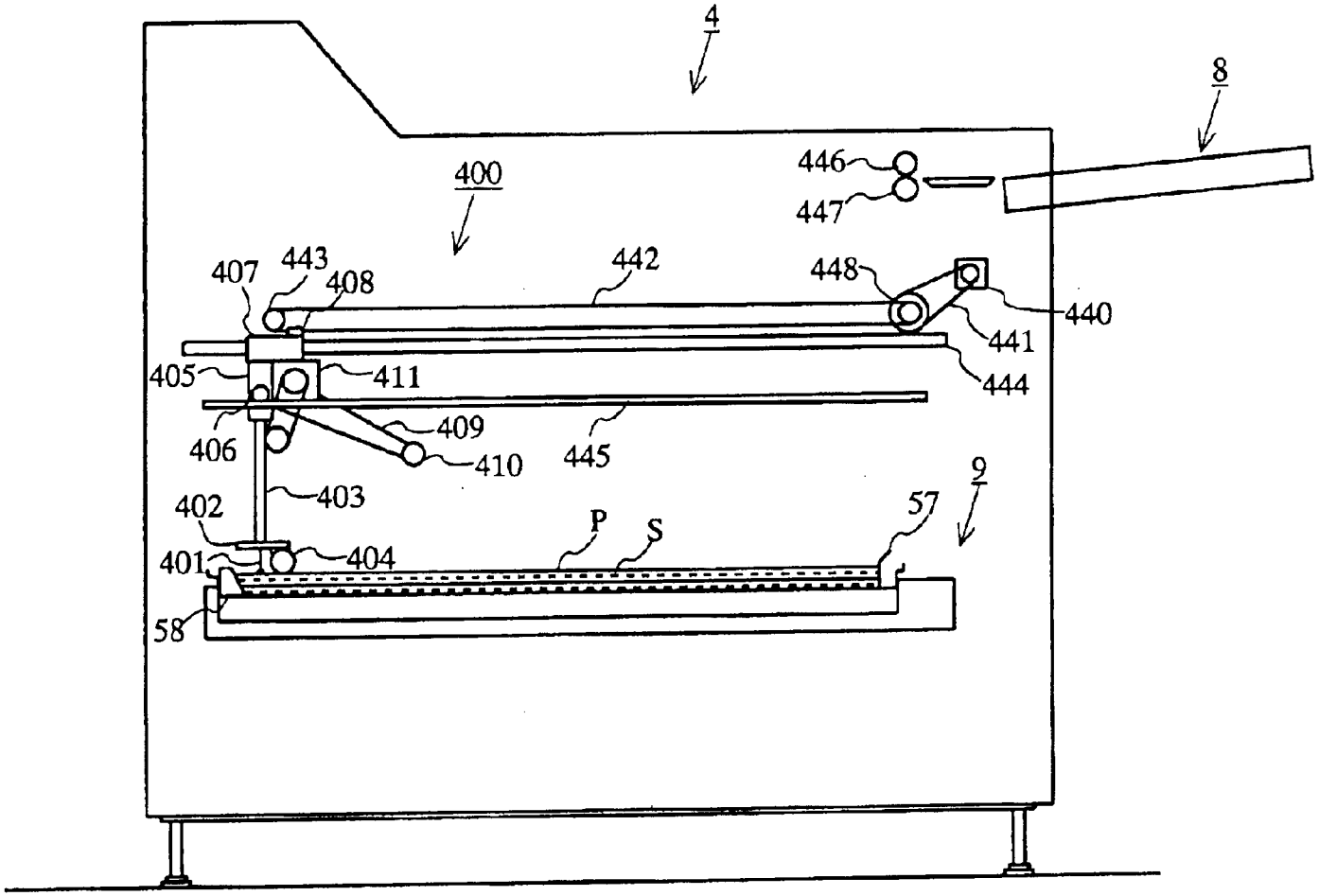
FIG. 4 is a view used for explaining the overall operation of a plate transfer mechanism 400 viewed from a side direction of an autoloader section 4 according to the first embodiment of the present invention.

The plate transfer mechanism 400 transfers plates P from the cassette 9 having moved to a plate supply position (as illustrated in FIG. 4) toward the conveyer section 8. The plate transfer mechanism 400 includes a pair of linear bush holders 407 each traveling along a slide rail 444 by receiving drive from an endless synchronous belt 442 which is caused to move rotationally by drive of a loader movement motor 440. The synchronous belt 442 is looped over a pair of drive pulleys 443 and 448 so as to move rotationally. A drive force of the loader movement motor 440 is transmitted to the synchronous belt 442 by rotating a drive pulley 448*a* via a belt 441. The drive force is transmitted to a drive pulley 448*b*, which is included in the other one of the pair of structures, via a horizontal shaft (not shown) having opposite ends to which either one of the drive pulleys 448*a* and 448*b* is connected and secured. The loader movement motor 440 rotates the pair of drive pulleys 448*a* and 448*b* in phase with each other. Each linear bush holder 407 has a coupling member 408 secured thereon. The coupling member 408 holds the synchronous belt 442 by sandwiching the synchronous belt 442 between two separate portions so as to receive the drive therefrom. Each linear bush holder 407 also includes a speed reducer 405 having a loader reversing pinion gear 406 to be engaged with a rack rail 445 provided in parallel with the slide rail 444. The speed reducer 405 is connected to a plurality of pad rods 403 via a coupling shaft and a loader base (not shown). The coupling shaft, the loader base, and the pad rods 403 are provided so as to pivot reversibly on the center of the coupling shaft at a pivoting speed controlled by the speed reducer 405. The pad rods 403 are connected at one end to either one of a pair of support boards 402 which will be described later. Each support board 402 includes a plurality of suction pads 401 for holding a plate P via suction. A pad rod vertical movement motor 411 is secured on the loader base. The pad rod vertical movement motor 411 causes the pad rods 403 to move with respect to the loader base, so as to change a distance between the loader base and the suction pads 401 provided at the end of the pad rod 403 (hereinafter, such a distance is referred to as the "stroke length" of the pad rods 403). Specifically, in order to cause the pad rods 403 to move up and down with respect to the loader base, the pad rod vertical movement motor 411 substantially causes the pad rods 403 to expand and contract. The detailed description of the above-described elements included in the plate transfer mechanism 400 will be provided later.

The pad rods 403 are connected at one end to a plurality of support rollers 404 for supporting a leading end portion of a plate P from the back face thereof when transferring that plate P. The loader base is coupled to a plurality of arms 409 each having a plurality of support rollers 410 provided at one end thereof. The support rollers 410 are used for supporting a central portion of the plate P from the back face thereof.

Figure 5:
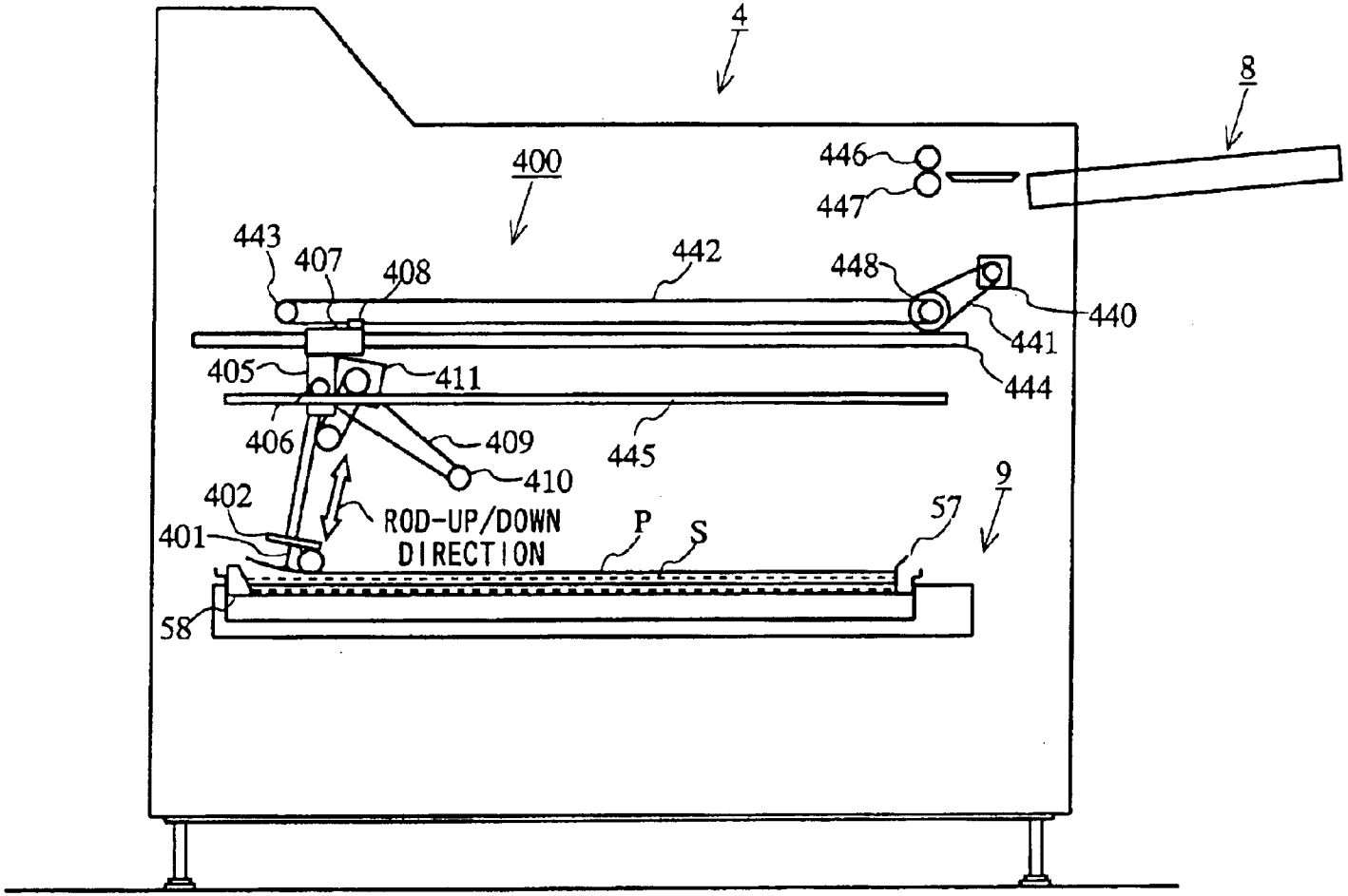
FIG. 5 is another view used for explaining the overall operation of the plate transfer mechanism 400 viewed from the side direction of the autoloader section 4 according to the first embodiment of the present invention.
Figure 6:
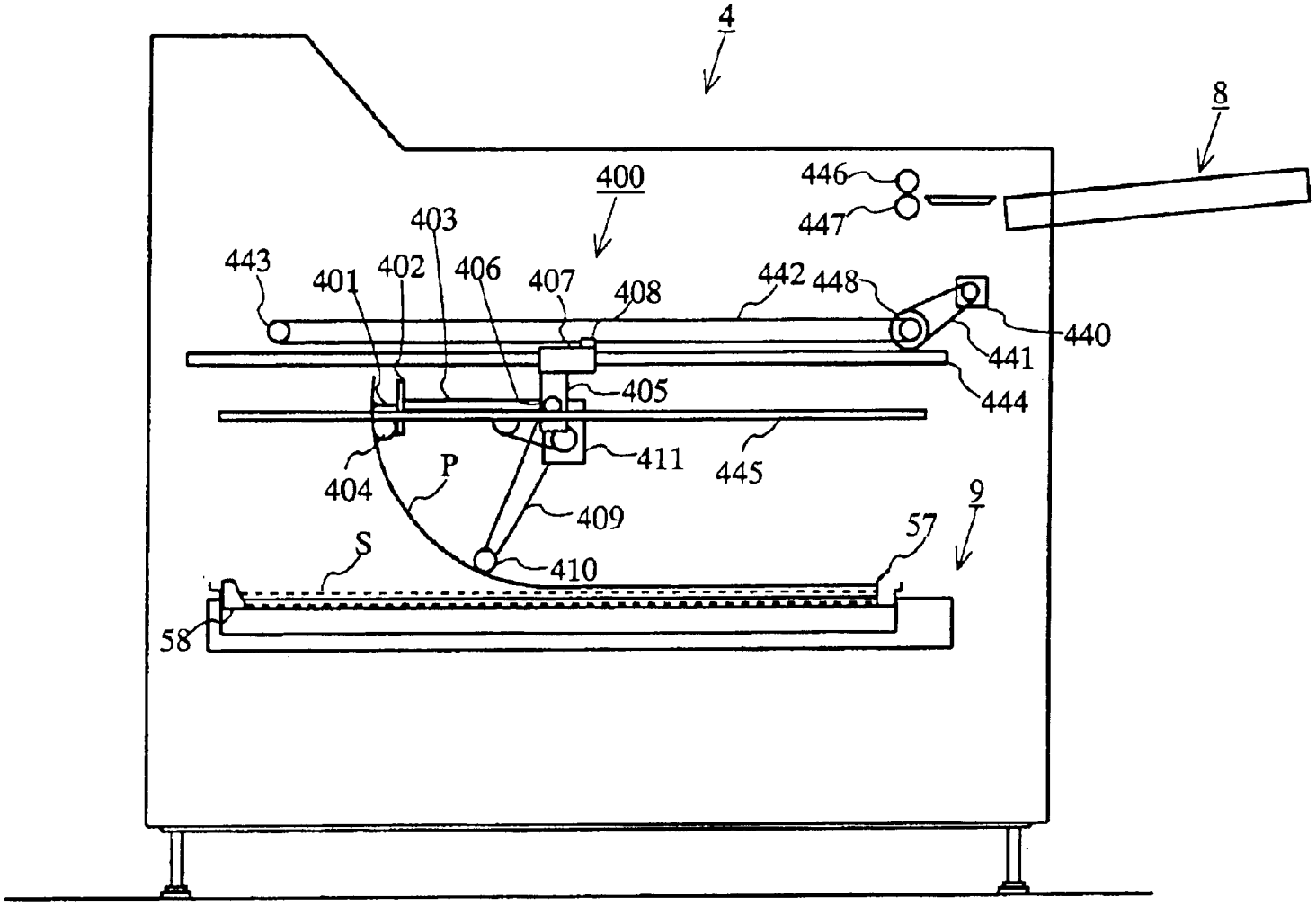
FIG. 6 is a still another view used for explaining the overall operation of the plate transfer mechanism 400 viewed from the side direction of the autoloader section 4 according to the first embodiment of the present invention.
Figure 7:
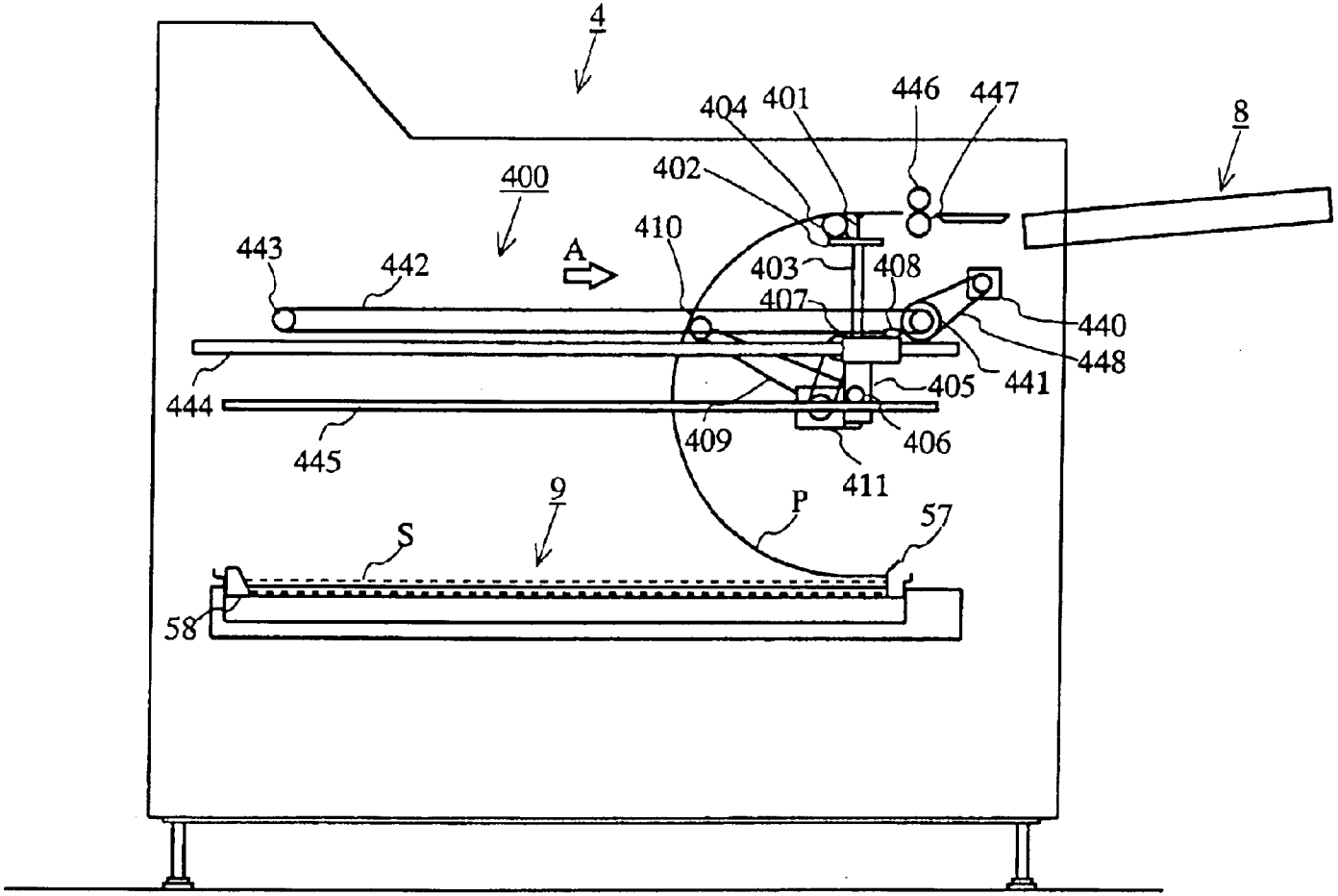
FIG. 7 is a still another view used for explaining the overall operation of the plate transfer mechanism 400 viewed from the side direction of the autoloader section 4 according to the first embodiment of the present invention.

In the case where the plate transfer mechanism 400 having the above-described structure is in the state illustrated in FIG. 4, when the linear bush holder 407 is driven by the loader movement motor 440 so as to move toward a direction to the right (hereinafter, referred to as the "transfer movement direction"), as illustrated in FIGS. 5–7, the pad rods 403 pivot on the center of the coupling shaft of the speed reducer 405 in a clockwise direction (hereinafter, referred to as the "transfer turn direction"; the following description is provided on the assumption that the pad rods 403 in the state of FIG. 4 are set at an angle of 0° in the transfer turn direction). Therefore, in the case where the suction pads 401 hold a proximal end portion, which is nearer to the suction pads, of a support layer side of a plate P via suction in the state illustrated in FIG. 4, and then, as illustrated in FIGS. 5–7, the linear bush holder 407 is driven by the loader movement motor 440 so as to move toward the transfer movement direction, when the pad rods 403 pivot 180° in the transfer turn direction, the plate P held via suction by the suction pads 401 is turned such that the plate's faces are reversed (i.e., the support layer of the plate P faces downwards). Thereafter, as illustrated in FIG. 7, a leading end of the plate P will be sandwiched between a pair of transfer rollers 446 and 447 for transferring the plate P to the conveyer section 8. In the transfer operation as described above, an end of the plate P opposite to the leading end is kept in contact with a positioning member 57, and therefore no friction is caused between the plate Panda slip sheet S located therebelow within the cassette 9.

Figure 8:
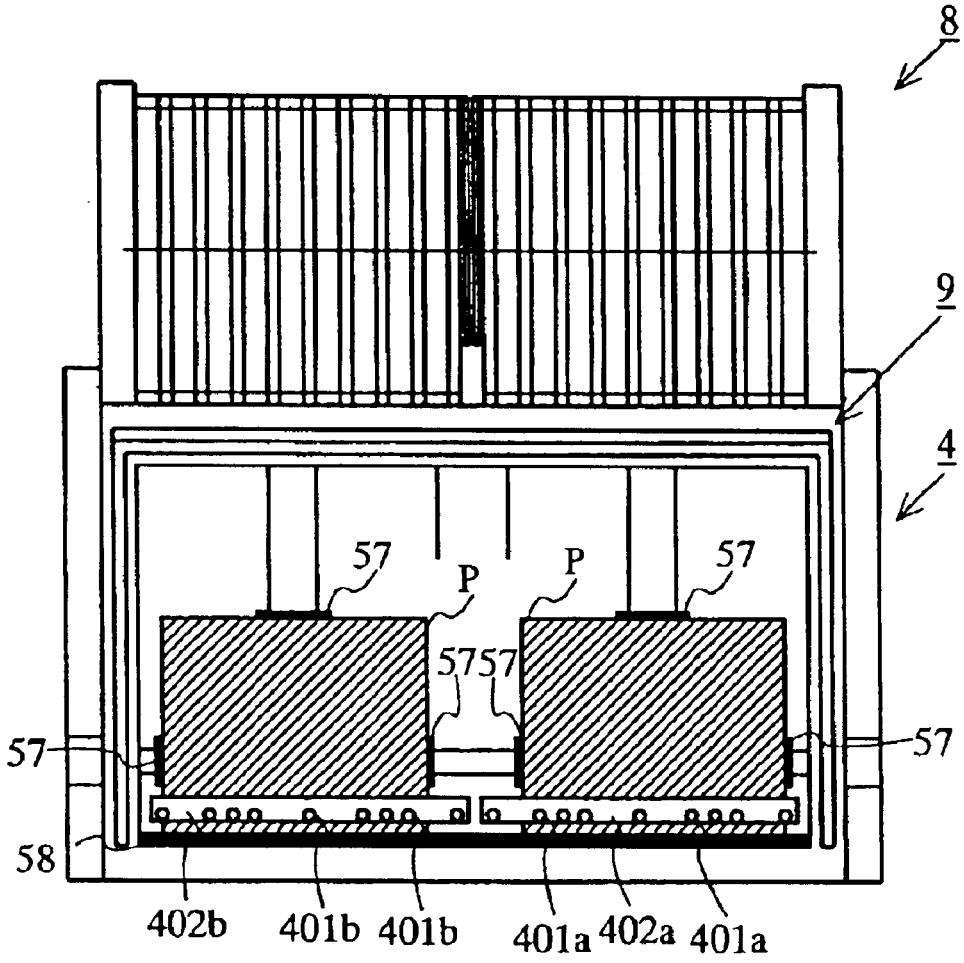
FIG. 8 is a top view used for explaining the plate transfer mechanism 400 according to the first embodiment of the present invention and illustrating the autoloader section 4 together with a conveyer section 8.
Figure 9:
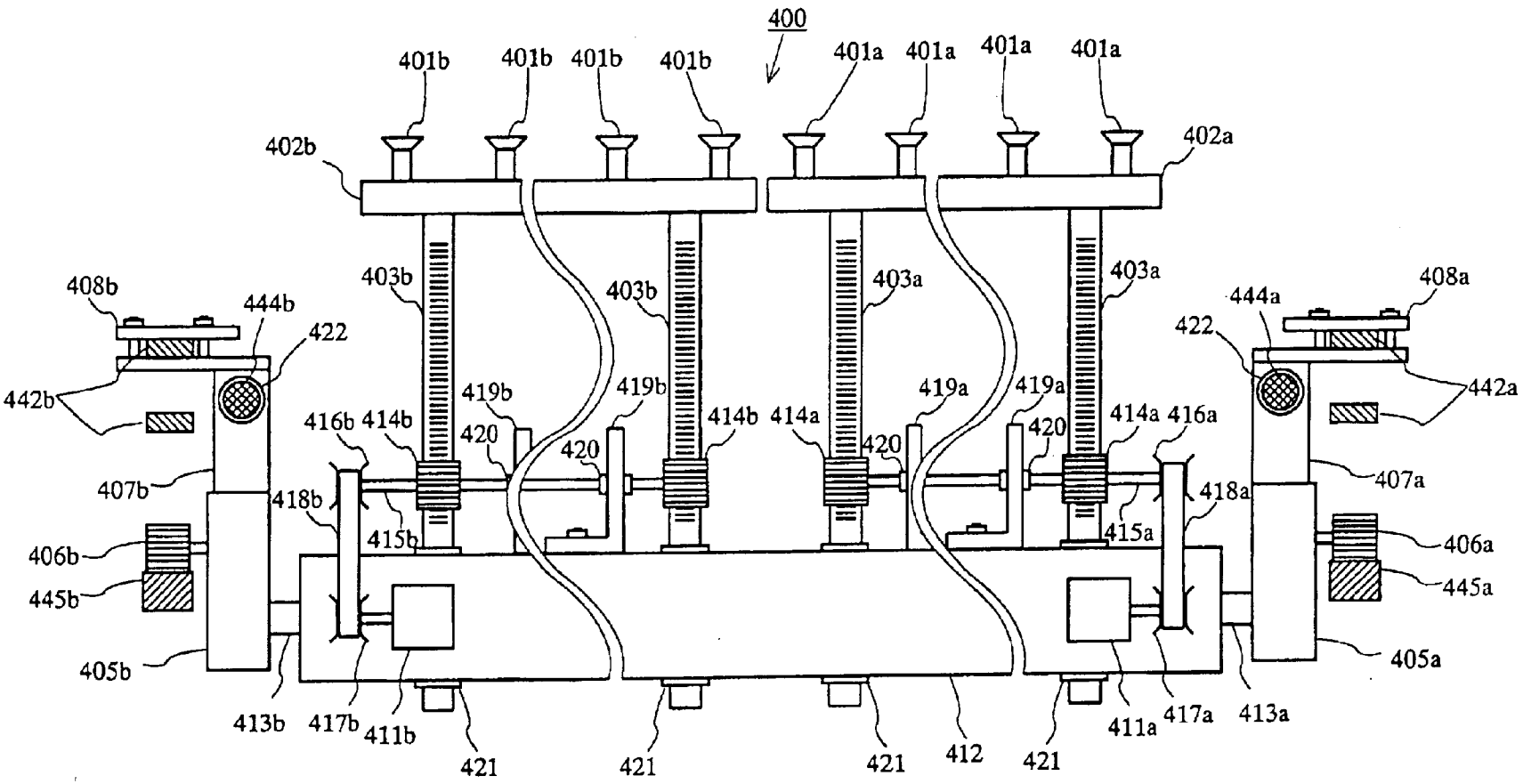
FIG. 9 is a front view of the plate transfer mechanism 400 according to the first embodiment of the present invention which is in the state of FIG. 7 and viewed from a direction A indicated in FIG. 7.
Figure 10:
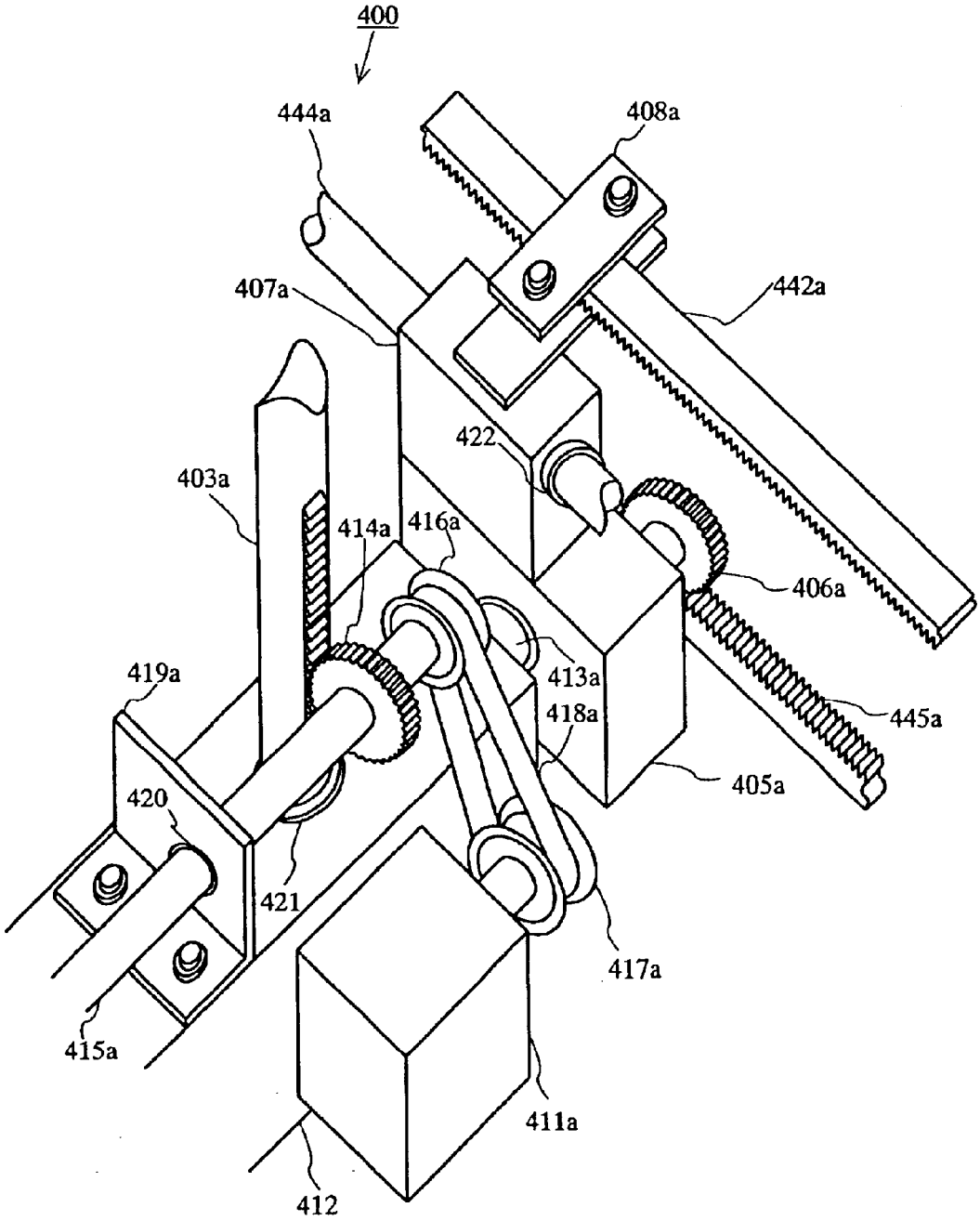
FIG. 10 is a perspective view illustrating a portion of one of a pair of structures included in the plate transfer mechanism 400 illustrated in FIG. 9.

Referring to FIGS. 8–10, the structure of the plate transfer mechanism 400 will be described in more detail. FIG. 8 is a top view used for explaining the structure of the plate transfer mechanism 400 and illustrating the autoloader section 4 together with the conveyer section 8. FIG. 9 is a front view of the plate transfer mechanism 400 in the state of FIG. 7 viewed from a direction A indicated in FIG. 7. FIG. 10 is a perspective view illustrating a portion of one of the pair of structures included in the plate transfer mechanism 400 illustrated in FIG. 9. In FIGS. 8 to 10, elements, which are not used in the detailed description of the plate transfer mechanism 400, are omitted for clarity of illustration.

In FIG. 8, a plurality of suction pads 401*a* and 401*b* are provided on a pair of support boards 402*a* and 402*b*, respectively. The support boards 402*a* and 402*b* are positioned so as to correspond to two plates P placed side-by-side in the cassette 9. As described above in conjunction with FIG. 2, all the suction pads 401*a* and 401*b* are connected via a hose (not shown) and the electromagnetic valve 452 (FIG. 2) controlled by the electronic section 450 so as to be in communication with the vacuum pump 451. The electronic section 450 controls negative pressure supplied to the suction pads 401*a* and 401*b*. As an example of negative pressure control, the electronic section 450 selects the intensity of negative pressure supplied to the suction pads 401*a* and 401*b* in accordance with the size of the plate P to be held via suction by the suction pads 401*a* and 401*b*. Alternatively, the suction pads 401*a* and 401*b* may be caused to move in a pad-array direction (a left-right direction in FIG. 8) in accordance with the size of the plate P to be held via suction by the suction pads 401*a* and 401*b*.

Referring to FIGS. 9 and 10, a pair of linear bush holders 407*a* and 407*b* include their respective slide rails 444*a* and 444*b* penetrating through a corresponding one of linear bushes 422. Coupling members 408*a* and 408*b* are secured on the linear bush holders 407*a* and 407*b*, respectively. The coupling members 408*a* and 408*b* hold the synchronous belts 442*a* and 442*b*, respectively, by sandwiching their respective synchronous belts 442*a* and 442*b* between two separate portions thereof. Thus, when the pair of synchronous belts 442*a* and 442*b* are rotated by the loader movement motor 440, the linear bush holders 407*a* and 407*b* move along the slide rails 444*a* and 444*b*, respectively, in accordance with the rotation of the synchronous belts 442*a* and 442*b*.

Speed reducers 405*a* and 405*b* are secured on the linear bush holders 407*a* and 407*b*, respectively. Each of the speed reducers 405*a* and 405*b* is configured such that when an input shaft is rotated, an output shaft is rotated at a rotation speed into which the input shaft's rotation speed is divided by a prescribed number. Loader reversing pinion gears 406*a* and 406*b* are attached to the input shafts of the speed reducers 405*a* and 405*b*, respectively. In the following description, the output shafts of the speed reducers 405*a* and 405*b* are interchangeably referred to as the "coupling shafts 413*a* and 413*b*", respectively. The loader reversing pinion gears 406*a* and 406*b* are in engagement with the rack rails 445*a* and 446*b*, respectively. Movements of the above-described linear bush holders 407*a* and 407*b* rotate the loader reversing pinion gears 406*a* and 406*b*, respectively, thereby rotating the input shafts of the speed reducers 405*a* and 405*b*. The coupling shafts 413*a* and 413*b* are secured at opposite ends of the loader base 412 having a substantially rectangular solid-like shape. Accordingly, when the loader reversing pinion gears 406*a* and 406*b* are rotated by the movements of the linear bush holders 407*a* and 407*b*, the loader base 412 pivots on the center of the coupling shafts 413*a* and 413*b* at the above-mentioned rotation speed obtained by dividing the input shaft's rotation speed by the prescribed number.

A couple of pad rods 403*a* and a couple of pad rods 403*b* are provided so as to move up and down through opposed side surfaces of the loader base 412 via bearings 421. Each of the pad rods 403*a* and 403*b* has a toothed rack formed in a cylindrical surface thereof. The toothed racks of the pad rods 403*a* and 403*b* are engaged with rod driving pinion gears 414*a* and 414*b*, respectively. The rod driving pinion gears 414*a* and 414*b* are respectively secured around drive shafts 415*a* and 415*b* which are respectively supported by drive shaft brackets 419*a* and 419*b* via bearings 420. The drive shaft brackets 419*a* and 419*b* are secured on one side surface of the loader base 412. Timing pulleys 416*a* and 416*b* are secured on one end of the drive shafts 415*a* and 415*b*, respectively.

The timing pulleys 416*a* and 416*b* respectively receive drive from endless synchronous belts 418*a* and 418*b* which are caused to move rotationally by drive of pad rod vertical movement motors 411*a* and 411*b*, respectively. The synchronous belt 418*a* is looped over the timing pulley 416*a* and a motor pulley 417*a* so as to move rotationally, and the synchronous belt 418*b* is looped over the timing pulley 416 band a motor pulley 417*b* so as to move rotationally. The pad rod vertical movement motors 411*a* and 411*b* rotationally drive the motor pulleys 417*a* and 417*b*, respectively, so that the drive forces of the pad rod vertical movement motors 411*a* and 411*b* are respectively transmitted to the timing pulleys 416*a* and 416*b* via the synchronous belts 418*a* and 418*b*, respectively. As the pad rod vertical movement motors 411*a* and 411*b*, for example, stepping motors having a controllable rotation angle are used. The pad rod vertical movement motors 411*a* and 411*b* are individually controlled by the electronic section 450 (illustrated in FIG. 2). By controlling individual operations of the pad rod vertical movement motors 411*a* and 411*b*, the electronic section 450 controls stroke movements of the pad rods 403*a* and 403*b* in a direction along which the pad rods 403*a* and 403*b* penetrate through the loader base 412 (hereinafter, such a direction is referred to as the "rod-up/down direction").

The pad rods 403*a* and 403*b* securely support a pair of support boards 402*a* and 402*b*, respectively. The support boards 402*a* and 402*b* include a plurality of suction pads 401*a* and 401*b*, respectively, so as to correspond to two plates P placed side-by-side. In the plate transfer mechanism 400 having the above-described structure, the electronic section 450 controls the loader movement motor 440 such that the suction pads 401*a* and 401*b* provided on the pair of support boards 402*a* and 402*b* are caused to be turned in the transfer turn direction, while moving toward the transfer movement direction. The electronic section 450 also controls the pad rod vertical movement motors 411*a* and 411*b* so as to drive the suction pads 401*a* and 401*b* to perform stroke movements in the rod-up/down direction.

Figure 11:
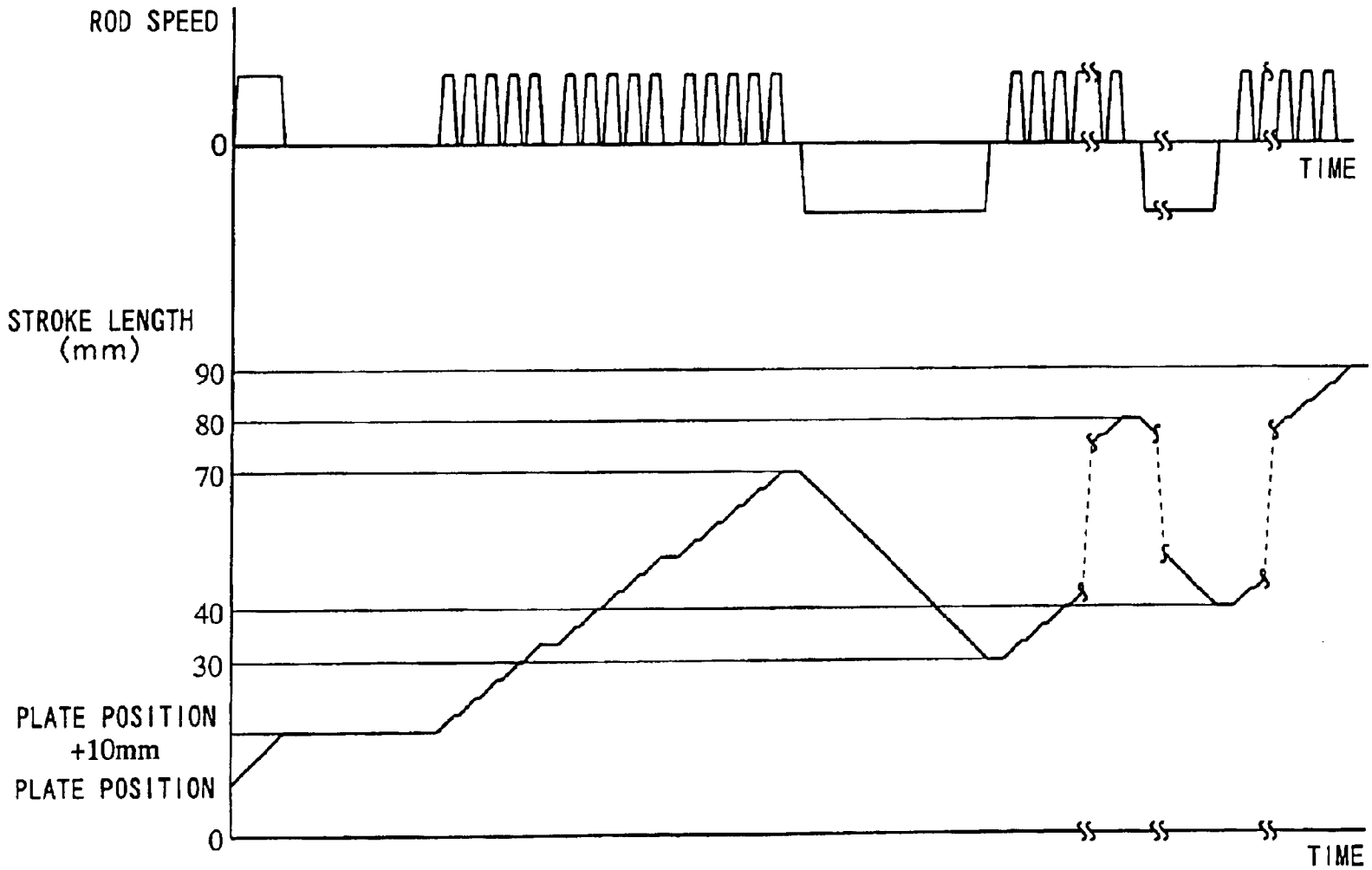
FIG. 11 illustrates graphs used for explaining vertical movement of pad rods 403 with respect to a loader base 412, i.e., adjustment of the stroke length of the pad rods 403.

Referring to FIG. 11, described next is control of an expansion and contraction operation of the pad rods 403 during a plate transfer by the plate transfer mechanism 400. Such control is performed for reliably sucking a plate P present at the top of a pile of plates P stored in a cassette 9 selected from among a plurality of cassettes 9 accommodated in the multicassette section 3, and for peeling off a slip sheet S adhering to the back face of the plate P.

FIG. 11 illustrates graphs used for explaining vertical movement of the pad rods 403 with respect to the loader base 412, i.e., adjustment of the stroke length of the pad rods 403. In FIG. 11, an upper graph indicates the speed of the pad rods 403 moving up and down (i.e., the speed of the pad rods 403 expanding and contracting), and a lower graph indicates variations of the stroke length of the pad rods 403. The speed indicated in the upper graph is represented by a positive value in a direction along which the suction pads 401 provided at the end of each pad rod 403 move toward the loader base 412 (i.e., a direction in which the stroke length of the pad rods 403 becomes shorter in the lower graph), while the negative value represents the speed in a direction along which the suction pads 401 move away from the loader base 412 (i.e., a direction in which the stroke length of the pad rods 403 becomes longer in the lower graph).

In the lower graph, the maximum possible stroke length (hereinafter, referred to as the "reference stroke length") corresponds to the length of the pad rods 403 caused to expand as much as possible by the pad rod vertical movement motor 411. The reference stroke length of the pad rods 403 corresponds to a position indicated by 0 mm in the lower graph. A decrease from the reference stroke length of the pad rods 403 is represented by a positive value, e.g., the stroke length at 30 (mm) in the lower graph is 30 mm shorter than the reference stroke length. In the present embodiment, the reference stroke length is designed so as to be equal to the stroke length of the pad rods 403 when the suction pads 401 provided at the end of each pad rod 403 vertically moves down and reaches the bottom of the cassette 9 storing no plates. However, the reference stroke length of the pad rods 403 does not have to be equal to such a stroke length. The reference stroke length may be set so as to become longer than the length actually required in the present embodiment in consideration of, for example, a case where the cassette 9 cannot be raised to a prescribed vertical position within the autoloader section 4 due to a malfunction of the raising and lowering mechanism 150 provided in the autoloader section 4, or a case where no raising and lowering mechanism is initially provided in the autoloader section 4.

In order to transfer the plates P toward the conveyer section 8 from the cassette 9, which has horizontally moved from the multicassette section 3 so as to be placed in the plate supply position within the autoloader section 4, the electronic section 450 controls the pad rods 403 so as to move down in the state where the pad rods 403 are set at an angle of 0° in the transfer turn direction of the plate transfer mechanism 400. Then, the electronic section 450 controls the suction pads 401 so as to closely contact a proximal end portion, which is nearer to the suction pads, of a support layer side of a plate P, which is present at the top of the plates P piled in the cassette 9 (the state as illustrated in FIG. 4), thereby securing that plate P via suction. Note that the stroke length of the pad rods 403 varies depending on the remaining amount of the plates P and slip sheets S piled in the cassette 9. As described above, the "plate position" shown in FIG. 11 indicates the stroke length of the pad rods 403 which have moved to such a position as to enable the suction pads 401 provided in the end of each pad rod 403 to suck a plate P present at the top of a pile of plates P and slip sheets S stored in the cassette 9. Since the "plate position" varies in accordance with a remaining amount of the plates P and slip sheets S piled in the cassette 9, the electronic section 450 adjusts the extension and contraction of the pad rods 403 in accordance with the "plate position", i.e., the vertical position of the plate P present at the top of the pile of plates P and slip sheets S stored in the cassette 9. The electronic section 450 determines whether the plate transfer mechanism 400 has reached the "plate position" by, for example, determining whether pressure detected by a pressure sensor (not shown) for detecting internal pressure of the suction pads 401 is less than or equal to a prescribed pressure value. Alternatively, the electronic section 450 may determine the stroke length of the pad rods 403 required for sucking the plate P present at the top of the pile of plates P and slip sheets S stored in the cassette 9, i.e., the "plate position", in accordance with the amount of plates p and slip sheets S ejected from the cassette 9.

As described above, a plurality of plates P of various sizes can be stored side-by-side in the cassette 9, and therefore there may be a difference in the remaining amount between plates P of different sizes. In such a case, the electronic section 450 controls the pad rod vertical movement motors 411*a* and 411*b* so as to cause the pad rods 403*a* and 403*b* to closely contact a corresponding plate P, and to reach respective different "plate positions". The pad rods 403*a* and 403*b* operate in the same manner during the separating operation described below, and therefore the pad rods 403*a* and 403*b* may be generically referred to as the "pad rods 403".

Once the pad rods 403 reach the plate position, the plate transfer mechanism 400 performs the separating operation for peeling off a slip sheet S from a back face of a plate P. As can be seen from FIG. 11, the electronic section 450 maintains the aforementioned state (as illustrated in FIG. 4) where the plate P is secured via suction, while driving the pad rod vertical movement motor 411 to cause the pad rods 403 to contract by 10 mm upwards from the plate position in the rod-up direction. Then, the electronic section 450 causes the loader transfer motor 440 to drive the linear bush holder 407 so as to move toward the transfer movement direction, thereby causing the pad rods 403 to pivot, preferably, 10° to 15° in the transfer turn direction (the state illustrated in FIG. 5). Note that the stroke length of the pad rods 403 is not changed while the pad rods 403 are pivotally moving.

Then, while maintaining the state where the plate P is secured via suction at 10° to 15° in the transfer turn direction, the electronic section 450 causes the pad rod vertical movement motor 411 to repeat a slight rotation and a pause, thereby causing the pad rods 403 to contract by 10 mm upwards from the plate position. This operation is repeatedly performed until the stroke length of the pad rods 403 becomes 70 mm shorter than the reference stroke length.

Then, the electronic section 450 drives the pad rod vertical movement motor 411 to cause the pad rods 403 so as to contract to a position where the stroke length of the pad rods 403 becomes 30 mm shorter than the reference stroke length. Then again, the electronic section 450 causes the pad rod vertical movement motor 411 to repeat a slight rotation and a pause, thereby causing the pad rods 403 to contract to a position where the stroke length of the pad rods 403 becomes 80 mm shorter than the reference stroke length.

Next, the electronic section 450 drives the pad rod vertical movement motor 411 to cause the pad rods 403 so as to expand to a position where the stroke length of the pad rods 403 becomes 40 mm shorter than the reference stroke length. Then again, the electronic section 450 drives the pad rod vertical movement motor 411 to repeat a slight rotation and a pause, thereby causing the pad rods 403 to contract to a position where the stroke length of the pad rods 403 becomes 90 mm shorter than the reference stroke length. Thus, the separating operation is completed.

Although the separating operation has been described above with respect to an exemplary case where the pad rods 403 are caused to slightly expand or contract, the pad rods 403 may be caused to expand or contract to a desired stroke length without stopping the movement of the pad rods 403. In such a case, the stroke length of the pad rods 403 may be set in accordance with the size of plates to be transferred and/or the size of the plate supplying apparatus.

After the completion of the separating operation, the plate transfer mechanism 400 transfers the plate P toward the conveyer section 8. The electronic section 450 maintains the state where the stroke length of the pad rods 403 is 90 mm shorter than the reference stroke length, while driving the loader transfer motor 440 to move the linear bush holders 407 in the transfer movement direction. The movement in the transfer movement direction causes the pad rods 403 securing the plate P via suction to pivot on the center of the output shafts (the coupling shafts 413) of the speed reducers 405 (a series of the states illustrated in FIGS. 5 to 7). Since the pad rods 403 move toward the transfer movement direction and then stop the movement after pivoting about 180° in the transfer movement direction, a face of the plate P held via suction by the suction pads 401 is reversed (i.e., the plate P is turned over such that the support layer thereof faces downwards), so that a leading end of the plate P is located in the vicinity of the pair of transfer rollers 446 and 447 for transferring the plate P toward the conveyer section 8. The electronic section 450 causes the pad rod vertical movement motor 411 to drive the pad rods 403 so as to move in the rod-up/down direction, thereby setting the leading end of the plate P at a carry-out position of the pair of transfer rollers 446 and 447. Then, the electronic section 450 causes the loader movement motor 440 to drive the linear bush holders 407 so as to move further along the transfer movement direction such that the leading end of the plate P contacts the pair of transfer rollers 446 and 447. The transfer roller 446 or 447 is then rotated to carry out the plate P toward the conveyer section 8. The transfer operation as described above is performed with the other end of the plate P being in contact with the positioning member 57, and therefore no friction is caused between the plate Panda slip sheet S located therebelow within the cassette 9.

After the plate P has been carried out to the conveyer section 8, the electronic section 450 drives the pad rod vertical movement motor 411 to cause the pad rods 403 to contract to a position where the stroke length of the pad rods 403 becomes 90 mm shorter than the reference stroke length. Then, the electronic section 450 controls the loader movement motor 440 so as to drive the plate transfer mechanism 400 to move to the position in which the pad rods 403 are set at an angle of 0° in the transfer turn direction. Thereafter, subsequent plate transfer is repeatedly operated.

In the separating operation as described above, the autoloader section 4 according to the first embodiment provides various vibrations to the plate P secured via suction by causing the pad rods 403 to repeat a slight ascent and a pause, and thereafter causing the pad rods 403 to make an abrupt descent, thereby reliably peeling off the slip sheet S adhering to the back face of the plate P. Further, the autoloader section 4 provides vibration in the rod-up/down direction to the plate P during the separating operation, and therefore only slight bending stress is applied to the plate P, so that the plate P is not pushed hard toward the direction of the cassette 9. Since the plate P undergoes only vibration and substantially no bending stress, it is possible to prevent the image recording layer of the plate P from being damaged by friction.

Since the pad rods 403 are able to expand and contract, a plate P to be transferred can be reliably secured via suction by the suction pads 401 provided at the end of each suction pad rod 403 regardless of the vertical position of the plate P to be transferred which is variable due to, for example, a remaining amount of plates P and slip sheets S in the cassette 9 or an error in a vertical position of the cassette 9 within the autoloader section 4. Accordingly, the plate P is not detached from the suction pads 401 when the plate transfer mechanism 400 transfers the plate P while turning over the plate P. Moreover, the mechanism for causing the pad rods 403 to expand and contract is provided independent from the mechanism for causing the pad rods 403 to pivot, and therefore, as described in conjunction with FIG. 11, it is possible to cause the pad rods 403 to expand and contract while keeping the pad rods 403 at a certain angle. Thus, it is possible to perform the separating operation with small bending stress applied to the plate P as compared to the separating operation performed by pivotally moving the pad rods 403.

Further, during transfer of the plate P after the separating operation, the autoloader section 4 controls the pad rods 403 so as to contract and perform an operation of turning over the plate P, and then the autoloader section 4 controls the pad rods 403 in the state of contraction so as to pivot back to a position at which the next plate P is sucked. Therefore, a moment of force required for causing the pad rods 403 to pivot is reduced, thereby reducing the drive force of the loader movement motor 440 for supplying such a moment of force, resulting in cost reduction. Moreover, the autoloader section 4 is able to adjust the position of the leading end of the plate P for carrying out the plate P by moving the pad rods 403 in the rod-up/down direction. Therefore, positional setting of the pair of transfer rollers 446 and 447 for carrying out the plate P toward the conveyer section 8 can be previously made in accordance with an adjustable range of the stroke length of the pad rods 403. Thus, it is possible to previously set the positions of the transfer rollers 446 and 447 in accordance with the height of the image recording section 6 located in the subsequent stage.

The plate supplying apparatus has been described above with respect to an exemplary case where a plurality of plates of various sizes are piled side-by-side in a cassette and plate transfer mechanisms are provided so as to correspond to plates piled on either side. However, in the case where the plurality of plates are piled on only one side of the cassette, one of the plate transfer mechanisms, which corresponds to that one side of the cassette, is only required to be operated. In such a case, for the other one of the plate transfer mechanisms, which corresponds to the other side of the cassette storing no plates, plates are supplied in the state where pad rods thereof are set to their shortest possible lengths. It goes without saying that if the plate supplying apparatus is required to supply only a plate at a time, the plate supplying apparatus may include only one plate transfer mechanism.

Figure 12:
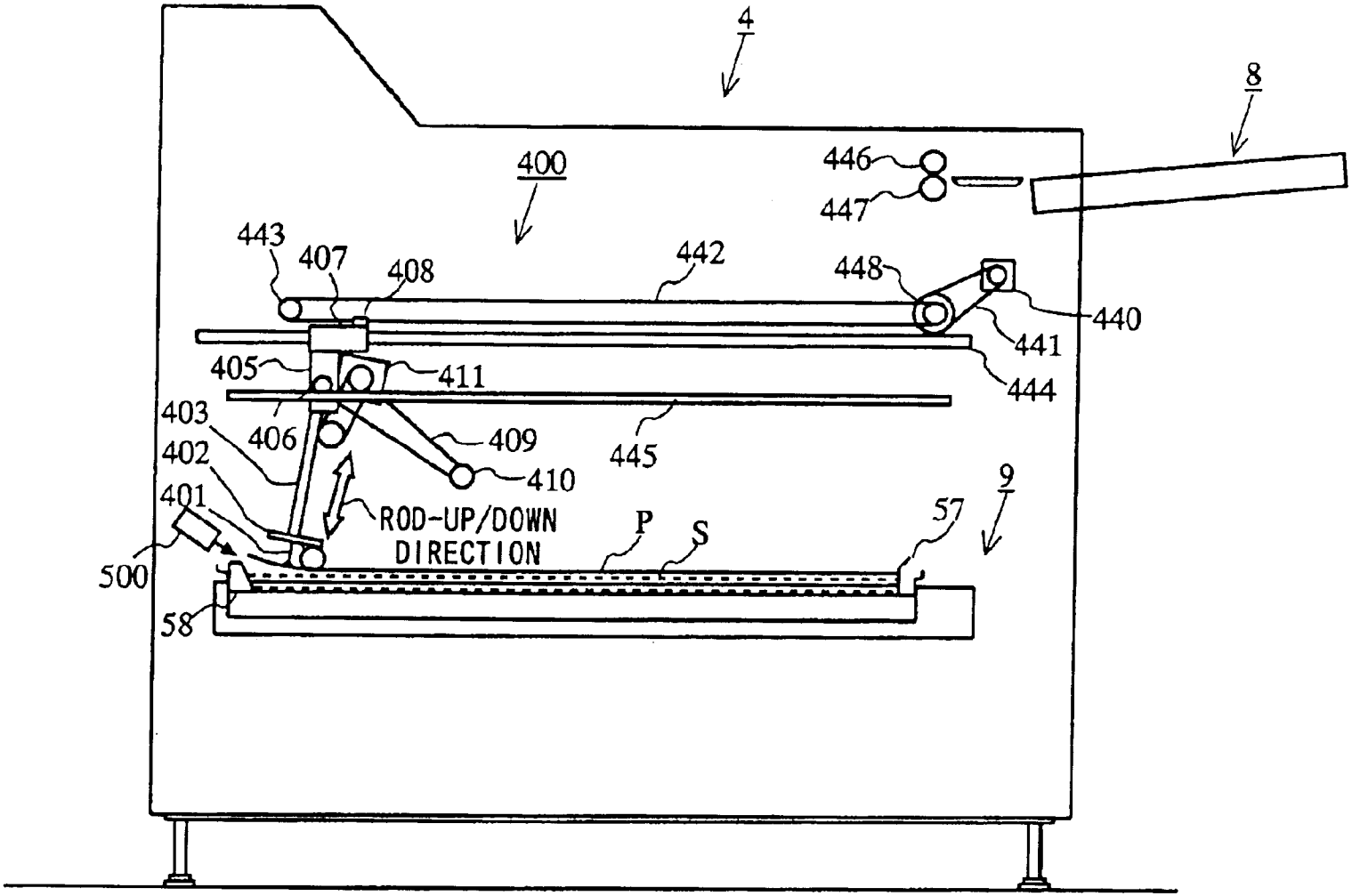
FIG. 12 is a view for explaining the overall operation of the plate transfer mechanism 400 viewed from a direction of one side thereof in an exemplary case where an air-blowing section 500 is provided to the autoloader section 4 according to the first embodiment of the present invention.

In order to more reliably peel off slip sheets S, a device for blowing air onto a plate P held by the suction pads 401 may be additionally provided. Referring to FIG. 12, the loader movement motor 440 drives the pad rods 403 so as to pivot in the transfer turn direction, so that a leading end of the plate P secured via suction by the suction pads 401 is partially separated from another plate P or a slip sheet S adhering to a back face of the plate P secured by suction. At this point, an air-blowing section 500 blows air onto the plate P secured by suction along a direction indicated by an arrow shown in the figure, thereby removing the slip sheet S adhering to the back face of the plate P secured by suction. It is more effective to blow air simultaneously while moving the pad rods 403 in the rod-up/down direction indicated by a double-headed outline arrow shown in the figure.

Figure 13:
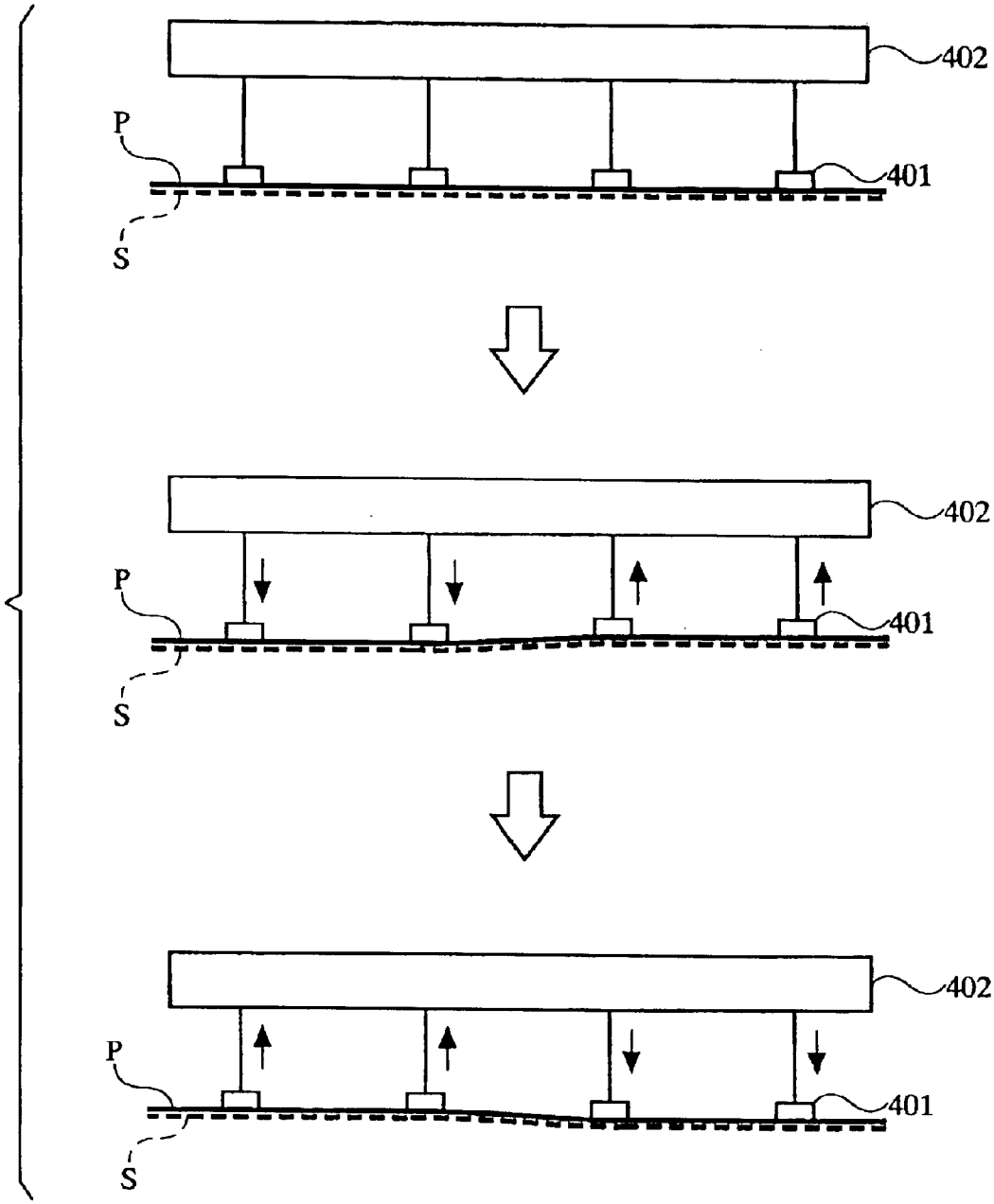
FIG. 13 is a diagram illustrating an exemplary case where suction pads 401 are caused to individually move up and down in the plate transfer mechanism 400 according to the first embodiment of the present invention.

In the first embodiment, the suction pads 401 are secured on the support board 402. However, in order to more reliably peel off the slip sheets S, the suction pads 401 may be provided so as to individually move up and down with respect to the support board 402. For example, as illustrated in FIG. 13, when a leading end of a plate P secured via suction by the suction pads 401 is raised from the cassette 9, the suction pads 401 on the right side of the support board 402 move up or down in a direction opposite to a direction along which the suction pads 401 on the left side move, thereby causing the plate P secured via suction to curve at a portion between the right and left sides. Alternatively, when the leading end of the plate P secured via suction by the suction pads 401 is raised from the cassette 9, the outermost suction pads 401 move up or down in a direction opposite to a direction along which the suction pads 401 at a center portion of the support board 402 move, thereby causing the plate P to curve in an array direction of the suction pads 401. In the above-described cases, it is possible to more reliably peel off the slip sheet S from the plate P secured via suction by the suction pads 401.

Although the plate supplying apparatus has been described above with respect to an exemplary case where plates are piled in a cassette such that each plate alternates with a slip sheet, the present invention is applicable to a case where only a plurality of plates are piled in the cassette.

(Second Embodiment)

A plate supplying apparatus according to a second embodiment of the present invention will be described below. An image recording system including the plate supplying apparatus according to the second embodiment has a structure similar to that of the image recording system including the plate supplying apparatus according to the first embodiment. In the following description, elements similar to those of the image recording system according to the first embodiment are denoted by the same reference numerals. Detailed description of such elements is omitted herein.

Figure 14:
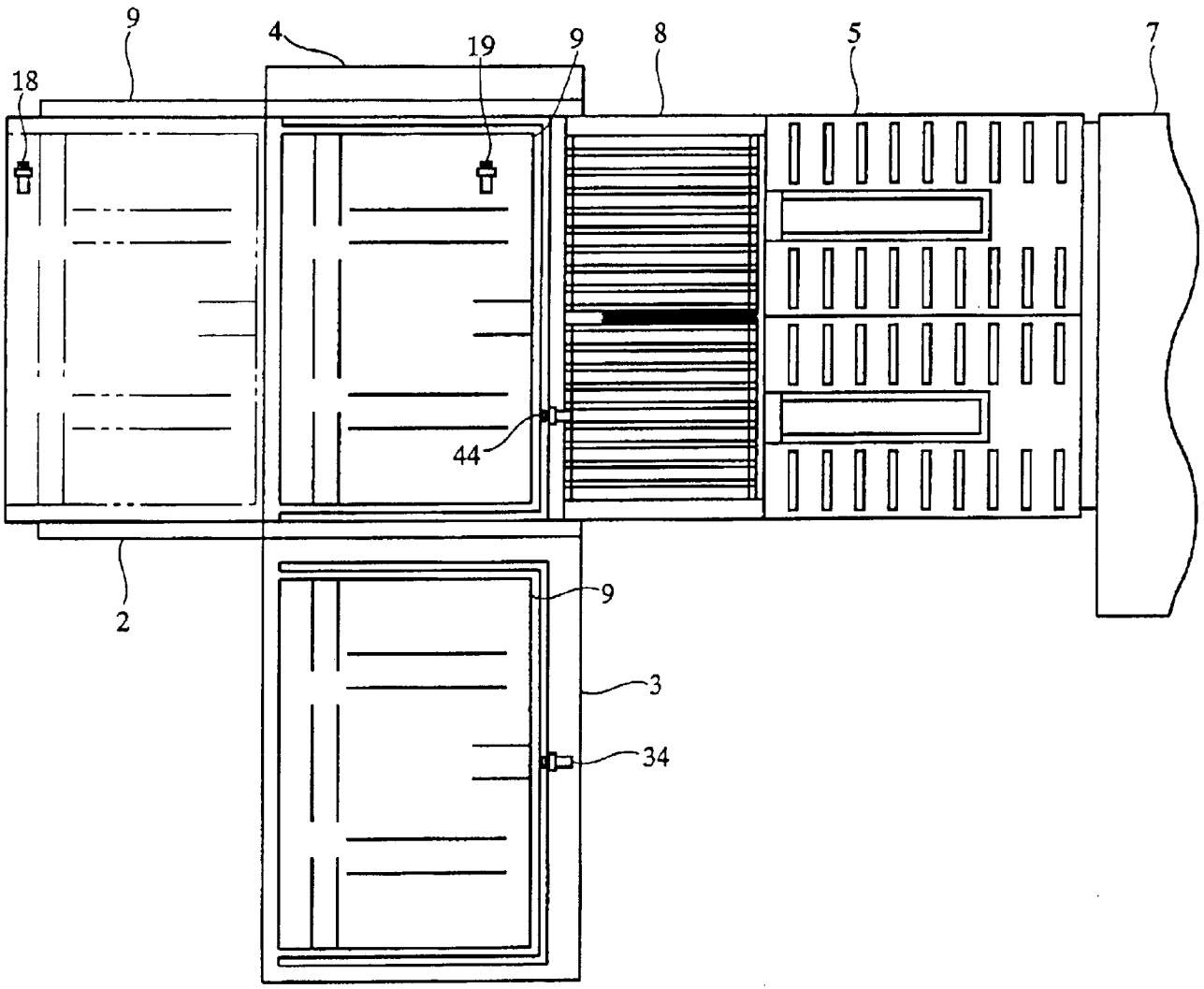
FIG. 14 is a schematic top view of an image recording system according to a second embodiment of the present invention.
Figure 15:
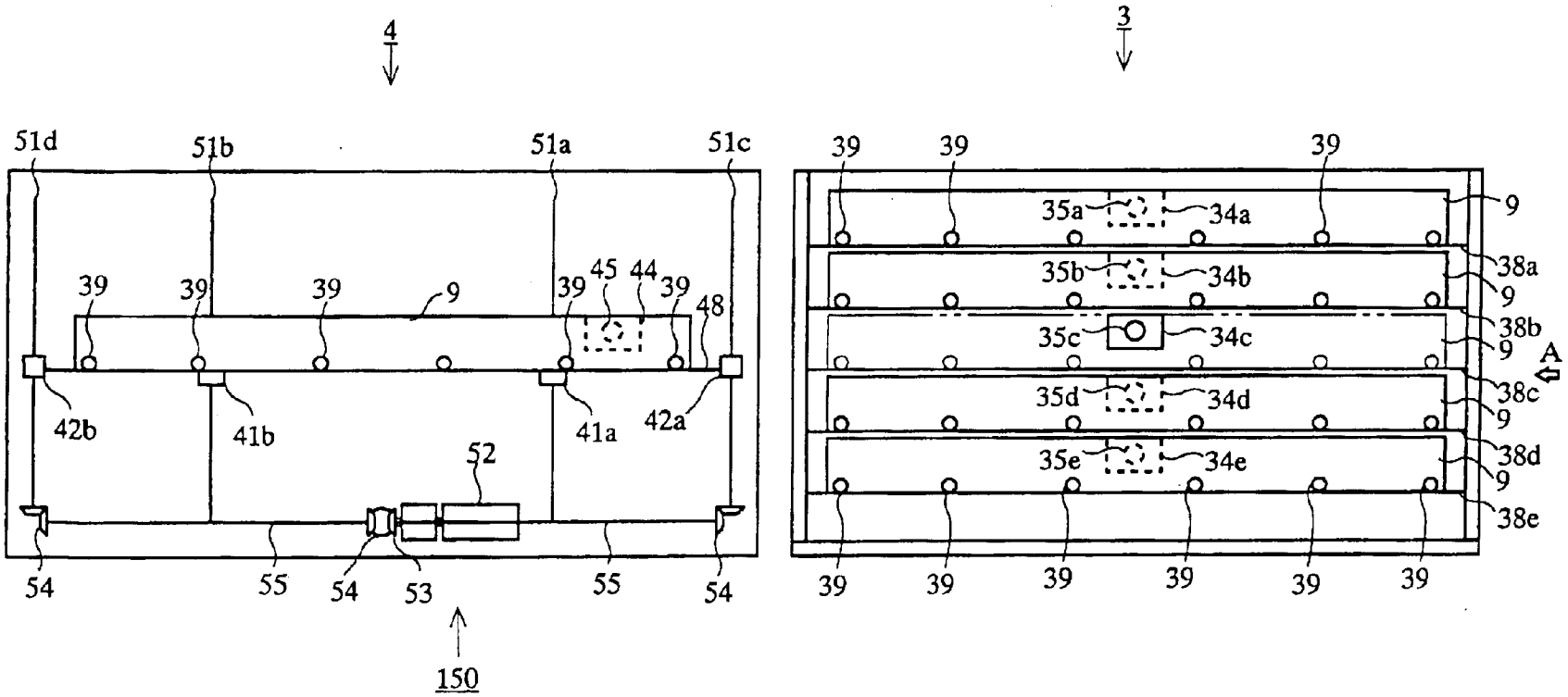
FIG. 15 is a side view illustrating a structure of a slide mechanism according to the second embodiment of the present invention, which is provided across a multicassette section 3 and the autoloader section 4, and a structure of a raising and lowering mechanism 150 provided in the autoloader section 4.
Figure 16:
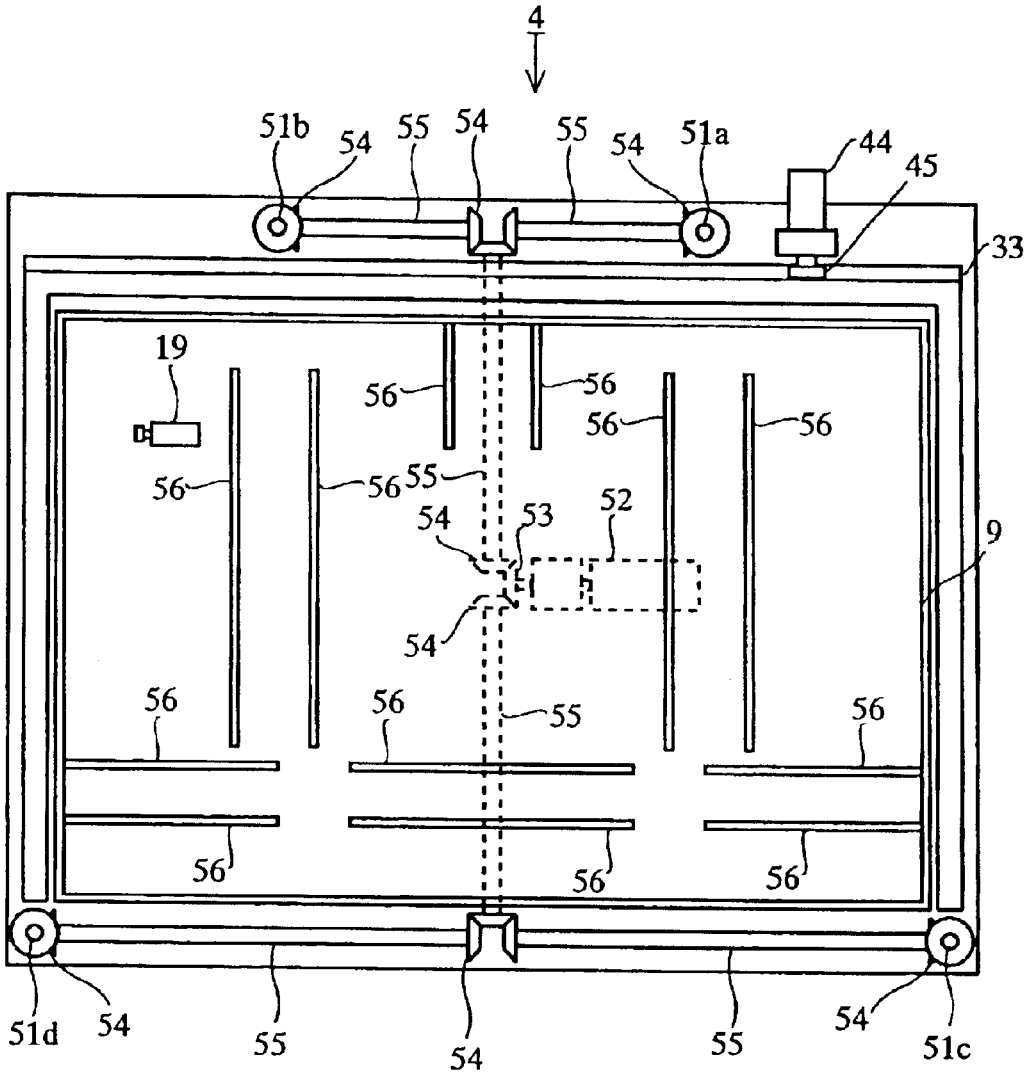
FIG. 16 is a top view illustrating the structure of the raising and lowering mechanism 150 provided in the autoloader section 4 according to the second embodiment of the present invention.
Figure 17:
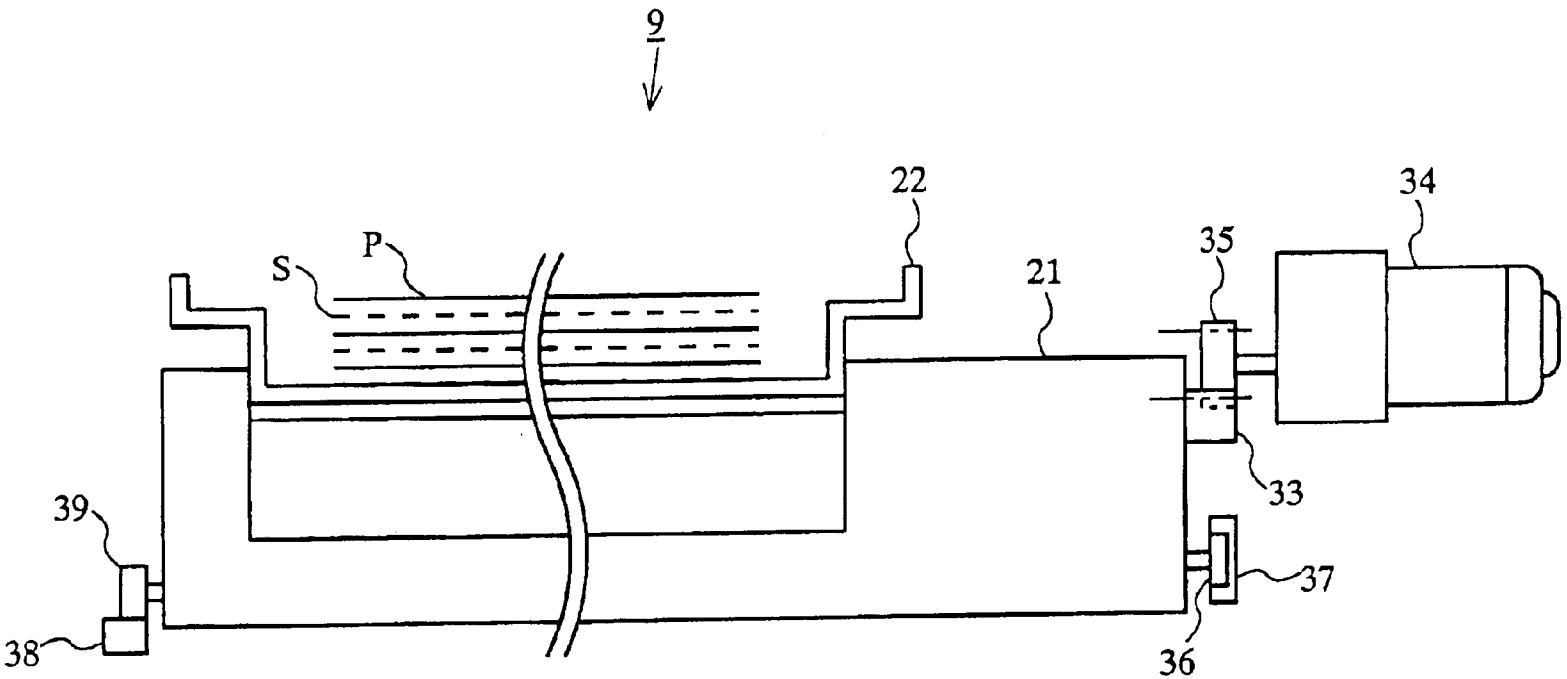
FIG. 17 is an enlarged view of principal portions viewed from a direction A indicated by an arrow shown in FIG. 15, which illustrates relationships among the cassette 9, the slide mechanism, and the raising and lowering mechanism 150 within the multicassette section 3 according to the second embodiment of the present invention.
Figure 18:
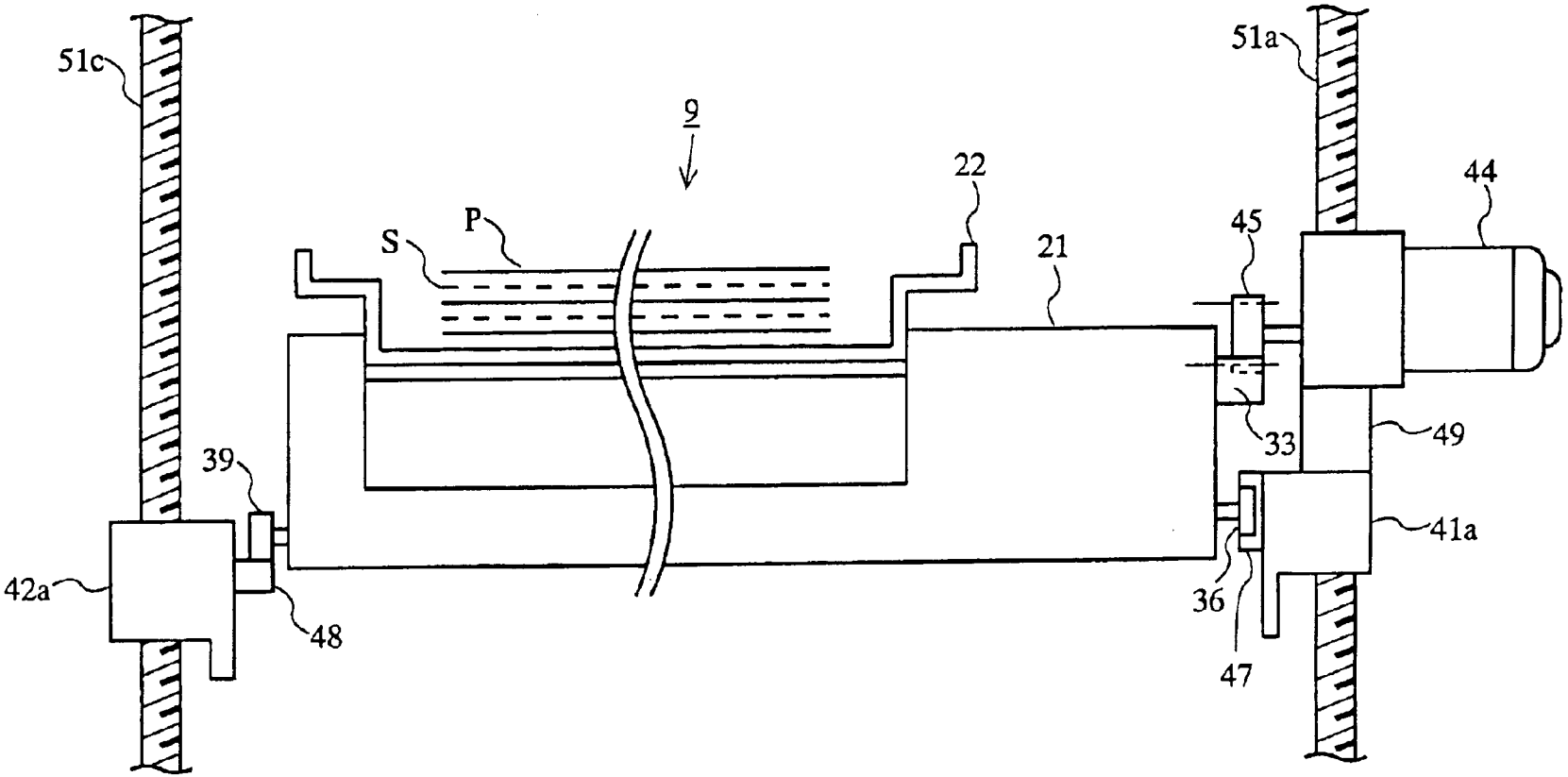
FIG. 18 is an enlarged view of principal portions viewed from the direction A shown in FIG. 15, which illustrates relationships among the cassette 9, the slide mechanism, and the raising and lowering mechanism 150 within the autoloader section 4 according to the second embodiment of the present invention.

Referring to FIGS. 14 to 18, described below are a structure of a slide mechanism for moving a cassette 9 between a multicassette section 3 and an auto loader section 4, and a structure of a raising and lowering mechanism 150 for raising and lowering the cassette 9 within the autoloader section 4. FIG. 14 is a schematic top view of the image recording system including the plate supplying apparatus according to the second embodiment. FIG. 15 is a side view illustrating a structure of the slide mechanism provided across the multicassette section 3 and the autoloader section 4, and a structure of the raising and lowering mechanism 150 provided in the autoloader section 4. FIG. 16 is a top view illustrating the structure of the raising and lowering mechanism 150 provided in the autoloader section 4. FIG. 17 is an enlarged view of principal portions viewed from a direction A indicated by an arrow shown in FIG. 15, which illustrates relationships among the cassette 9, the slide mechanism, and the raising and lowering mechanism 150 within the multicassette section 3. FIG. 18 is an enlarged view of principal portions viewed from the direction A shown in FIG. 15, which illustrates relationships among the cassette 9, the slide mechanism, and the raising and lowering mechanism 150 within the autoloader section 4.

In FIG. 15, five cassettes 9 are accommodated in the multicassette section 3 in a stacked manner as described above. As illustrated in FIG. 17, each of the five cassettes 9 includes an outer tray 21, and an inner tray 22 provided in the outer tray 21. Plates P are stored into the inner tray 22 such that each plate P alternates with a slip sheet S. A rack 33 is provided on one external side face of the outer tray 21. The rack 33 is engaged with one of five pinions 35*a* to 35*e* rotationally driven by motors 34*a* and 34*e*, respectively, which are secured in the multicassette section 3 in accordance with positions in which the five cassettes 9 are placed within the multicassette section 3. In the following description, the motors 34*a* to 34*e* and the pinions 35*a* to 35*e* may be generically referred to as the "motors 34" and the "pinions 35", respectively.

As illustrated in FIG. 17, a plurality of rollers 36 are provided on one external side face of the outer tray 21 of each of the five cassettes 9. The rollers 36 are engaged with one of five guiding members 37*a* to 37*e* which are provided in the multicassette section 3 in accordance with the positions in which the five cassettes 9 are placed within the multicassette section 3. Further, a plurality of rollers 39 are provided on an external side face of the outer tray 21 of each cassette 9 opposed to the side face where the rollers 36 are provided. The rollers 39 are engaged with one of five supporting rails 38*a* to 38*e* which are provided in the multicassette section 3 in accordance with the positions in which the five cassettes 9 are placed within the multicassette section 3. In the following description, the guiding members 37*a* to 37*e* and the supporting rails 38*a* to 38*e* may be generically referred to as the "guiding members 37" and the "supporting rails 38", respectively.

When any one of the motors 34*a* to 34*e* rotationally drives a corresponding one of the pinions 35*a* to 35*e*, the rotation of that one pinion causes movement of the rack 33 provided on the outer tray 21 of a cassette 9 placed in the position corresponding to that one of the motors 34*a* to 34*e*, thereby moving the entire cassette 9 along a right to left direction in FIG. 15 (a direction perpendicular to the sheet of FIG. 17). Accordingly, each of five cassettes 9 horizontally moves from the multicassette section 3 to the autoloader section 4 in accordance with drive from a corresponding one of the motors 34*a* to 34*e*.

Referring to FIGS. 15, 16, and 18, a plurality of ball screws 51*a* to 51*d* are provided in the autoloader section 4. The autoloader section 4 includes a guiding member 47 similar to each one of the five guiding members 37*a* to 37*e* of the multicassette section 3, and a supporting rail 48 similar to each one of the five supporting rails 38*a* to 38*e* of the multicassette section 3. The guiding member 47 is coupled to guiding member brackets 41*a* and 41*b*, and the supporting rail 48 is coupled to supporting rail brackets 42*a* and 42*b*. The ball screws 51*a* and 51*b* pass through the guiding member brackets 41*a* and 41*b*, respectively, so as to be engaged therewith, and the ball screws 51*c* and 51*d* pass through the supporting rail brackets 42*a* and 42*b*, respectively, so as to be engaged therewith. The autoloader section 4 also includes a motor 44 similar to the motor 34 of the multicassette section 3, and a pinion 45. The motor 44 is provided so as to be coupled to the guiding member bracket 41*a* via a coupling member 49, and to move up and down together with the guiding member bracket 41*a*.

As illustrated in FIGS. 15 and 16, a raising and lowering motor 52, which includes a miter gear 53 provided on its rotation shaft, is provided at the center of a lower portion of the autoloader section 4. The miter gear 53 is coupled to all of the ball screws 51*a* to 51*d* via a plurality of shafts 55 each having miter gears 54 on its opposite ends. The raising and lowering motor 52 drives the ball screws 51*a* to 51*d* to rotate in the same rotation direction. Accordingly, the drive from the raising and lowering motor 52 causes up/down movement of the guiding member brackets 41*a* and 41*b* and the supporting rail brackets 42*a* and 42*b*, which are engaged with the ball screws 51*a* to 51*d*, respectively, thereby making it possible to raise/lower the guiding member 47, the supporting rail 48, and the motor 44 which are coupled to the guiding member brackets 41*a* and 41*b* and the supporting rail brackets 42*a* and 42*b*. In the following description, the ball screws 51*a* to 51*d*, the guiding member brackets 41*a* and 41*b*, and the supporting rail brackets 42*a* and 42*b* may be generically referred to as the "ball screws 51", the "guiding member brackets 41", and the "supporting rail brackets 42", respectively.

FIG. 15 shows the state where a cassette 9 located in a central portion of the multicassette section 3 (the third cassette 9 from the top) has moved to the autoloader section 4. In this state, the guiding member 47 and the supporting rail 48 of the autoloader section 4 are aligned with the guiding member 37*c* and the supporting rail 38*c* of the multicassette section 3. The pinion of the autoloader section 4 is positioned at the same level as that of the pinion 35*c* of the multicassette section 3. The distance between the pinion 35*c* and the pinion 45 is shorter than the length of the rack 33 provided to the cassette 9.

In the state as described above, when the motor 34*c* of the multicassette section 3 rotationally drives the pinion 35*c*, while the motor 44 of the autoloader section 4 rotationally drives the pinion 45, the cassette 9 accommodated in the multicassette section 3 initially receives, at its rack 33, the drive from the pinion 35*c*, and then is guided by the guiding member 37*c* and the supporting rail 38*c*, thereby starting to move from the multicassette section 3 to the autoloader section 4.

After a leading end of the cassette 9 moves into the autoloader section 4, the cassette 9 is guided by the guiding member 47 and the supporting rail 48 of the autoloader section 4. Then, the rack 33 of the cassette 9 is engaged with the pinion 45 of the autoloader section 4. Once the cassette 9 is brought into a state of receiving the drive from the pinion 45, the rack 33 is disengaged from the pinion 35*c* of the multicassette section 3.

After the rack 33 is disengaged from the pinion 35*c* of the multicassette section 3, the cassette 9 receives drive from the pinion 45 of the autoloader section 4, and further moves through the autoloader section 4 so as to come into a state as shown in FIG. 15. Thereafter, drive from the raising and lowering motor 52 causes the cassette 9 to move up or down to a plate supply position from which the plates P stored in the cassette 9 are transferred toward the image recording section 6, or to a cassette ejection position from which the cassette 9 is moved to the plate supplying section 2.

In order to store a plurality of plates P of various sizes side-by-side in the cassette 9, a plurality of grooves 56 for attaching positioning members used for positioning the plurality of plates P of various sizes are formed in a bottom face of the cassette 9. Drives of the motors 34*a* to 34*e*, the motor 44, and the raising and lowering motor 52 are controlled by the electronic section 450.

The structure of the cassette 9 of the second embodiment is similar to that of the cassette 9 of the first embodiment described with reference to FIG. 3. Elements similar to those described in the first embodiment are denoted by the same reference numerals, and detailed description thereof is omitted.

Referring to FIGS. 19 to 22, described next are a schematic structure and a transfer operation of the plate transfer mechanism 400 for transferring plates P from the cassette 9 placed in the plate supply position toward the conveyer section 8, and an operation of the raising and lowering mechanism 150 during the transfer operation. FIGS. 19 to 22 are views used for explaining the overall operation of both the plate transfer mechanism 400 and the raising and lowering mechanism 150 viewed from a side direction of the autoloader section 4. Note that the plate transfer mechanism 400 has a pair of structures in order to transfer two plates P stored side-by-side as described above. Since the pair of structures operate in the same manner, elements of the pair of structures are genetically denoted by the same reference numerals, and the following description is given with respect to only one of the pair of structures.

Figure 19:
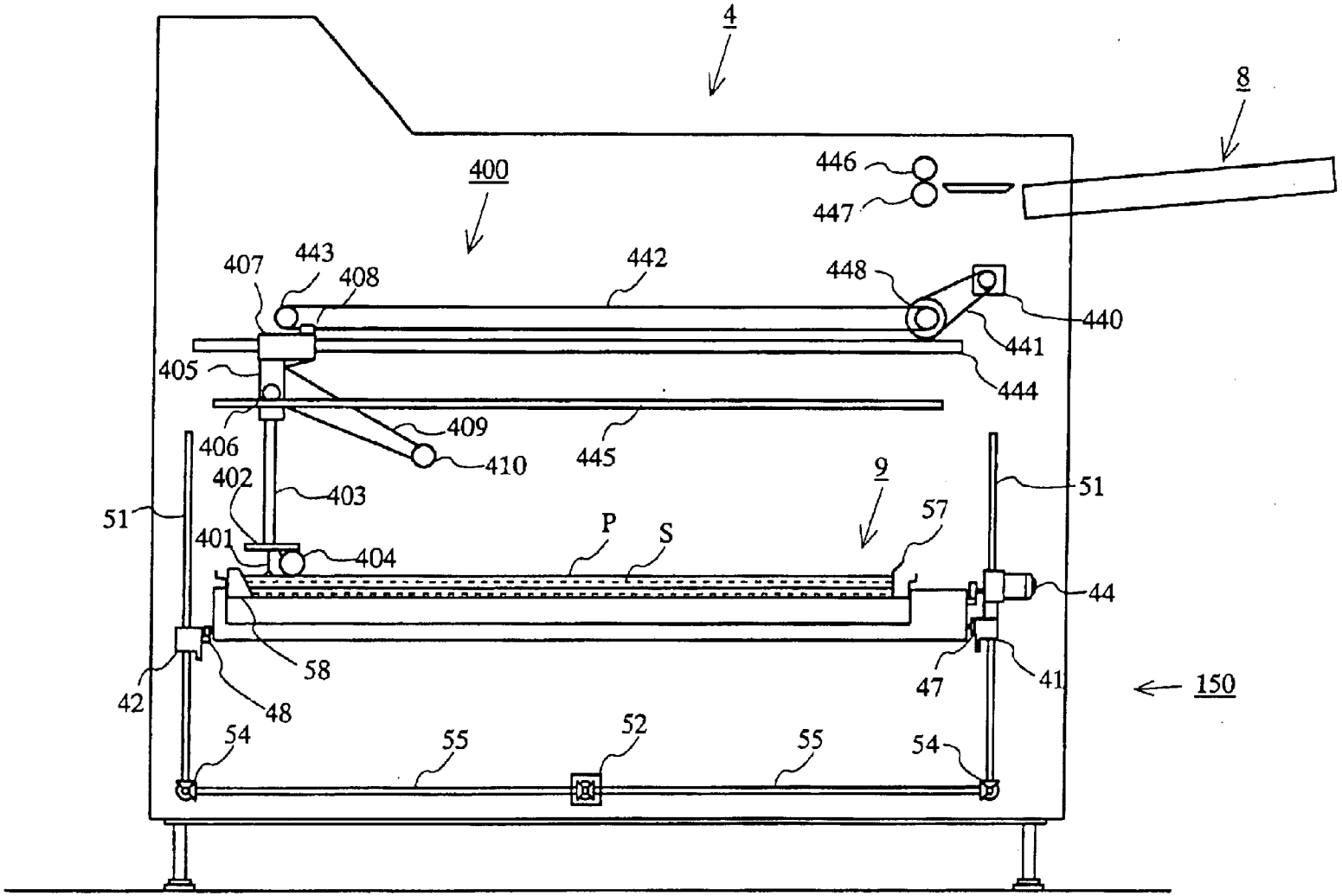
FIG. 19 is a view used for explaining the overall operation of both the plate transfer mechanism 400 and the raising and lowering mechanism 150 viewed from a side direction of the autoloader section 4 according to the second embodiment of the present invention.

Firstly, a schematic structure of the plate transfer mechanism 400 is described. The plate transfer mechanism 400 transfers plates P from the cassette 9, which is moved to a plate supply position (as illustrated in FIG. 19) by the raising and lowering mechanism 150, toward the conveyer section 8. The plate transfer mechanism 400 includes a linear bush holder 407 which travels along a slide rail 444 by receiving drive from an endless synchronous belt 442 which is caused to move rotationally by drive of a loader movement motor 440. The synchronous belt 442 is looped over a pair of drive pulleys 443 and 448 so as to move around the two drive pulleys 443 and 448. A drive force of the loader movement motor 440 is transmitted to the synchronous belt 442 by rotating the drive pulley 448 via the belt 441. The drive force is transmitted to another drive pulley 448 of the other one of structures via a horizontal shaft (not shown) having opposite ends to which either one of the pair of drive pulleys 448 is connected and secured. The loader movement motor 440 rotates the pair of drive pulleys 448 in phase with each other. The linear bush holder 407 has a coupling member 408 secured thereon. The coupling member 408 holds the synchronous belt 442 by sandwiching the synchronous belt 442 between two separate portions so as to receive drive therefrom. A speed reducer 405 having a loader reversing pinion gear 406 is provided on the linear bush holder 407. The loader reversing pinion gear 406 is in engagement with a rack rail 445 provided in parallel with the slide rail 444. The speed reducer 405 is connected to a plurality of pad rods 403 via a coupling shaft and a loader base (not shown). The coupling shaft, the loader base, and the pad rods 403 are provided so as to rotate reversibly about centers of the coupling shafts at a rotation speed controlled by the speed reducer 405. The pad rods 403 are connected at one end to a support board 402 which includes a plurality of suction pads 401 for holding a plate P via suction.

The pad rods 403 are connected at one end via the support board 402 to a support roller 404 for supporting a leading end portion of a plate P from the back face thereof in order to transfer that plate P. The loader base is coupled to an arm 409 having a support roller 410 provided at one end thereof. The support roller 410 is used for supporting a central portion of the plate P from the back face.

Figure 20:
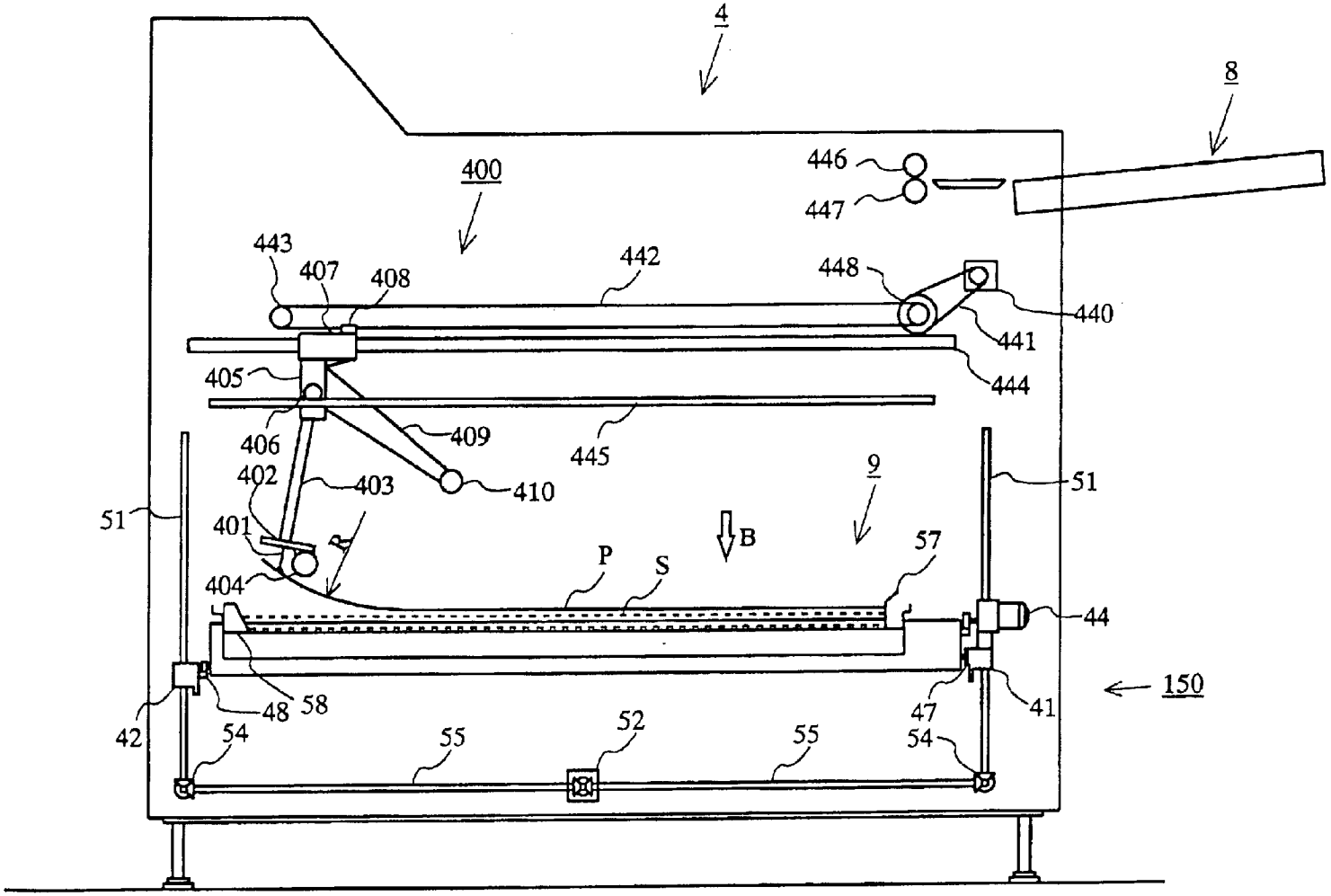
FIG. 20 is another view used for explaining the overall operation of both the plate transfer mechanism 400 and the raising and lowering mechanism 150 viewed from a side direction of the autoloader section 4 according to the second embodiment of the present invention.
Figure 21:
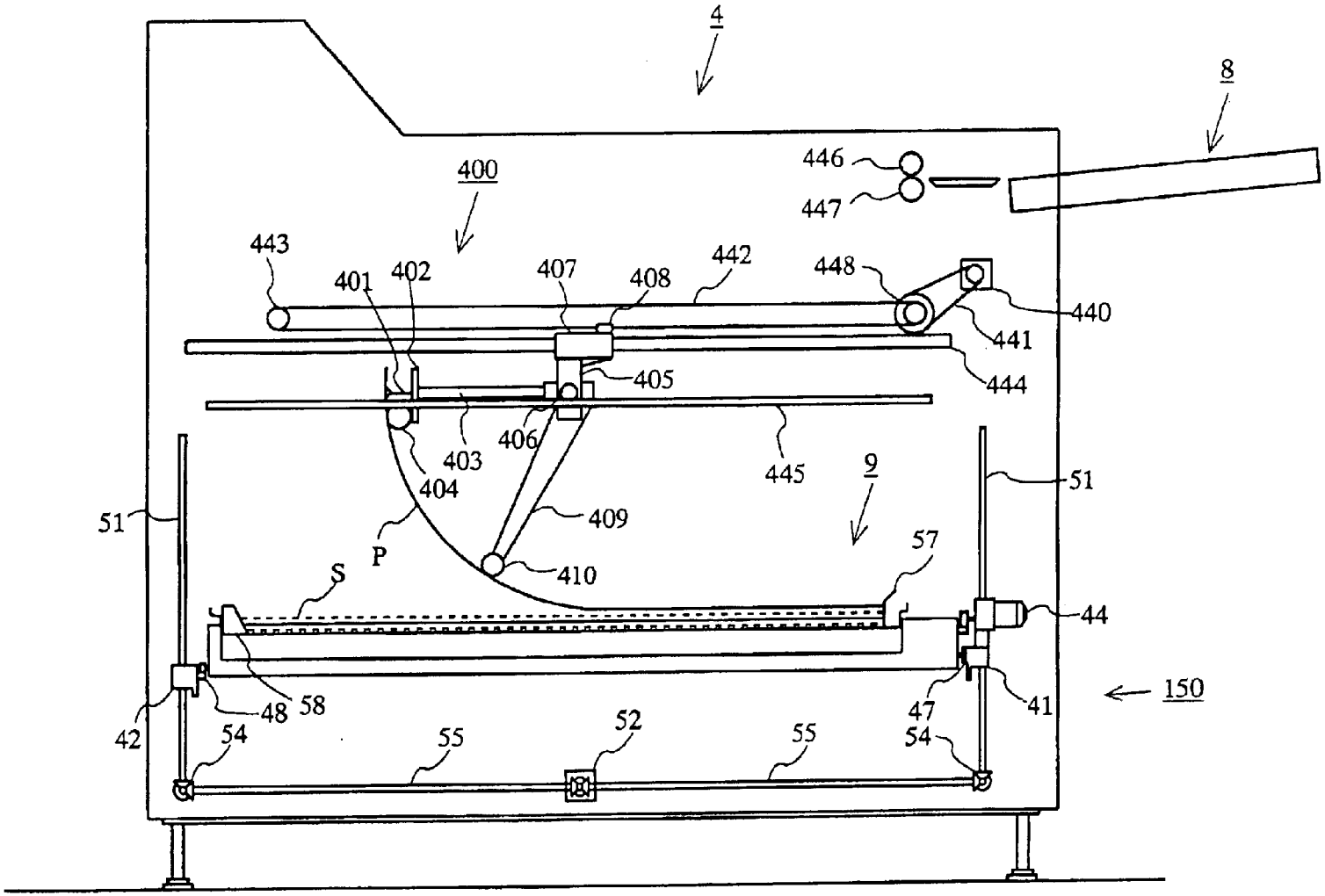
FIG. 21 is a still another view used for explaining the overall operation of both the plate transfer mechanism 400 and the raising and lowering mechanism 150 viewed from a side direction of the autoloader section 4 according to the second embodiment of the present invention.
Figure 22:
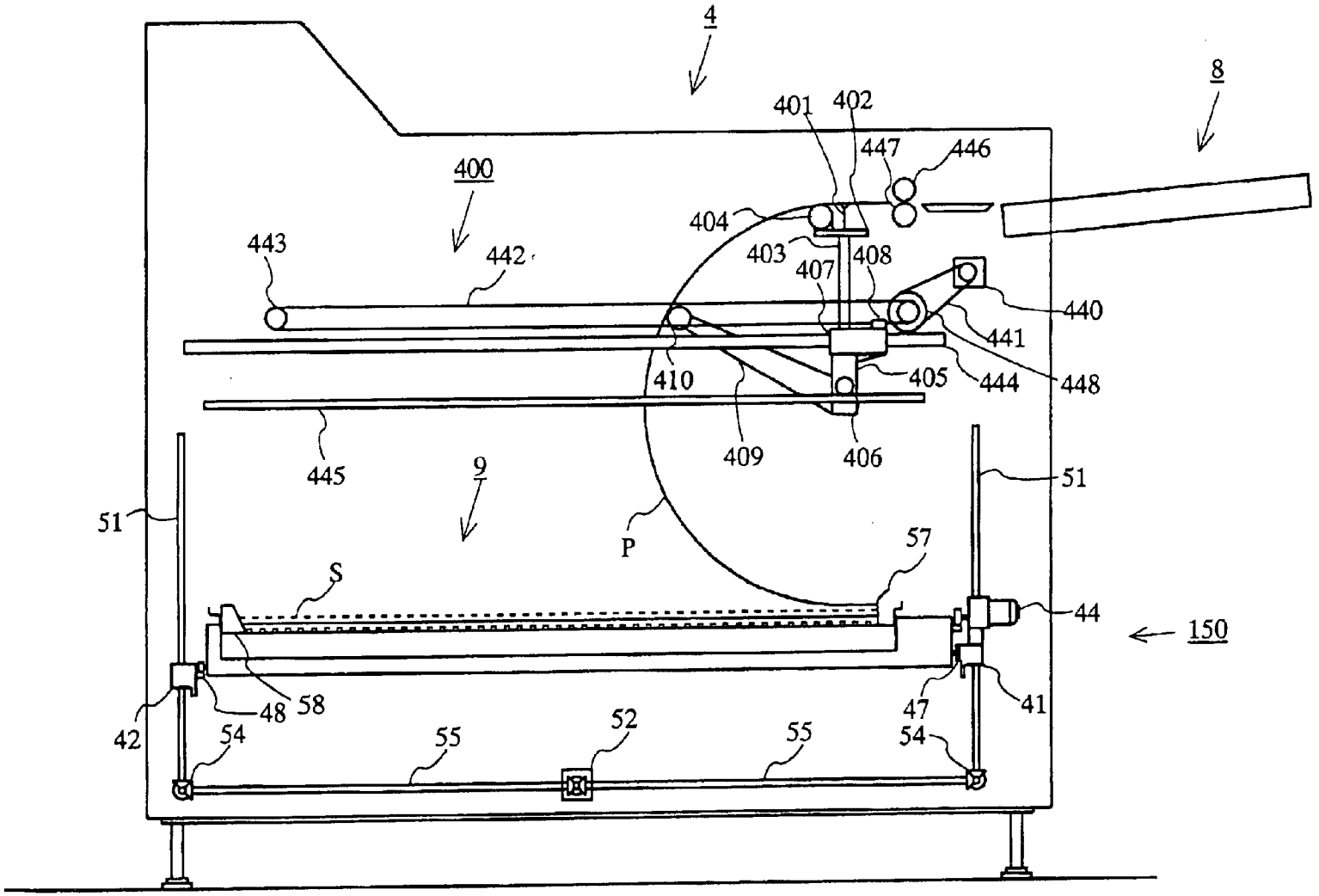
FIG. 22 is a still another view used for explaining the overall operation of both the plate transfer mechanism 400 and the raising and lowering mechanism 150 viewed from a side direction of the autoloader section 4 according to the second embodiment of the present invention.
Figure 23:
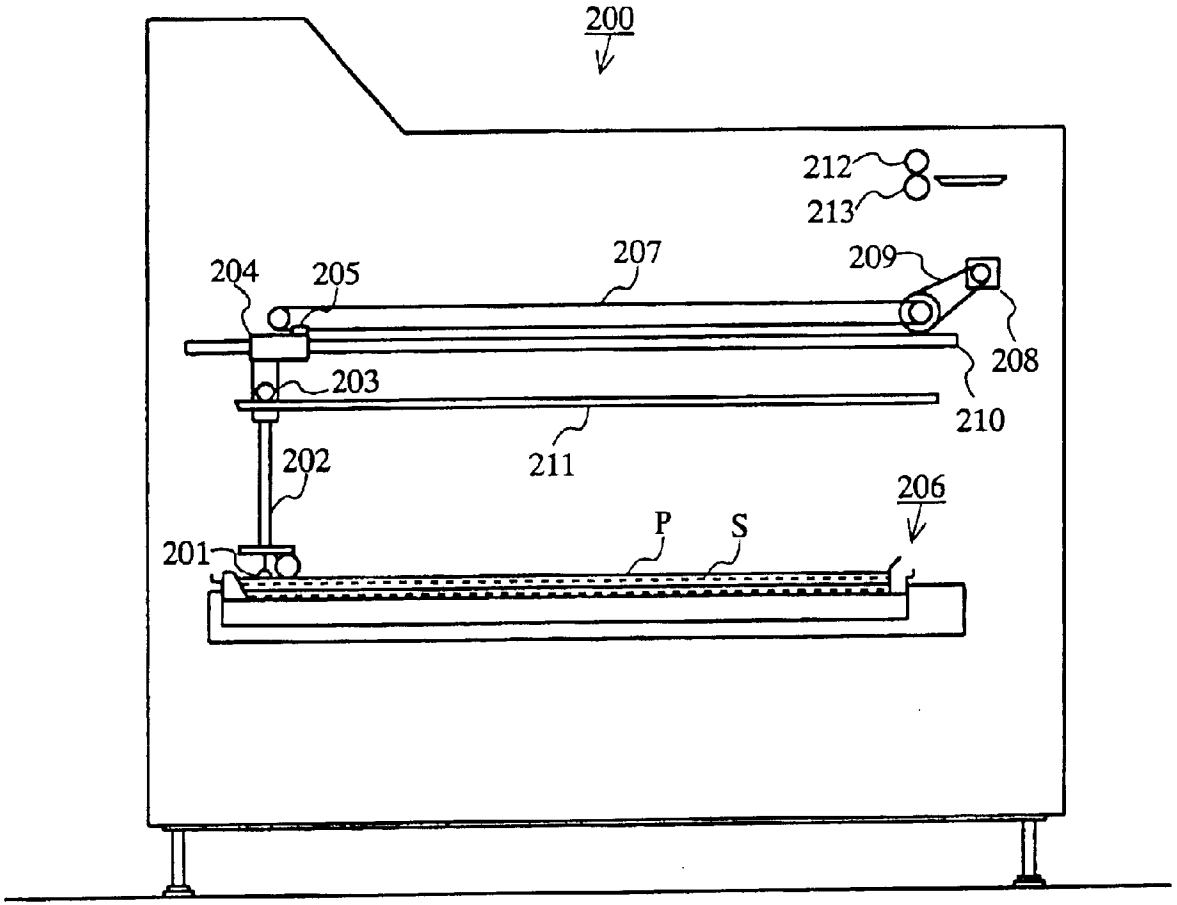
FIG. 23 PRIOR ART
FIG. 23 is one of views used for explaining a series of operation of a plate transfer mechanism which is included in a conventional plate supplying apparatus 200 and used for transferring plates P from a cassette 206 toward an image recording apparatus.
Figure 24:
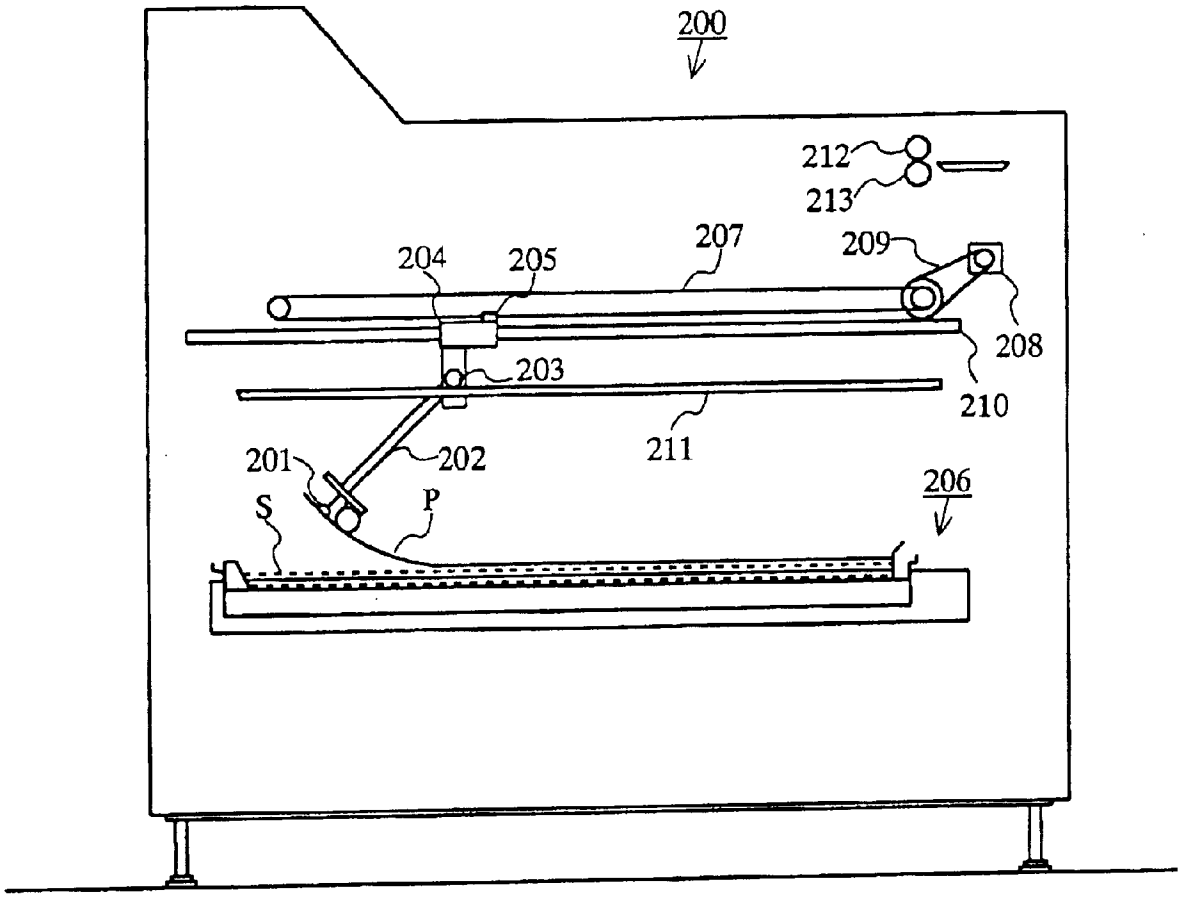
FIG. 24 PRIOR ART
FIG. 24 is another one of the views used for explaining a series of operation of the plate transfer mechanism which is included in the conventional plate supplying apparatus 200 and used for transferring plates P from the cassette 206 toward the image recording apparatus.
Figure 25:
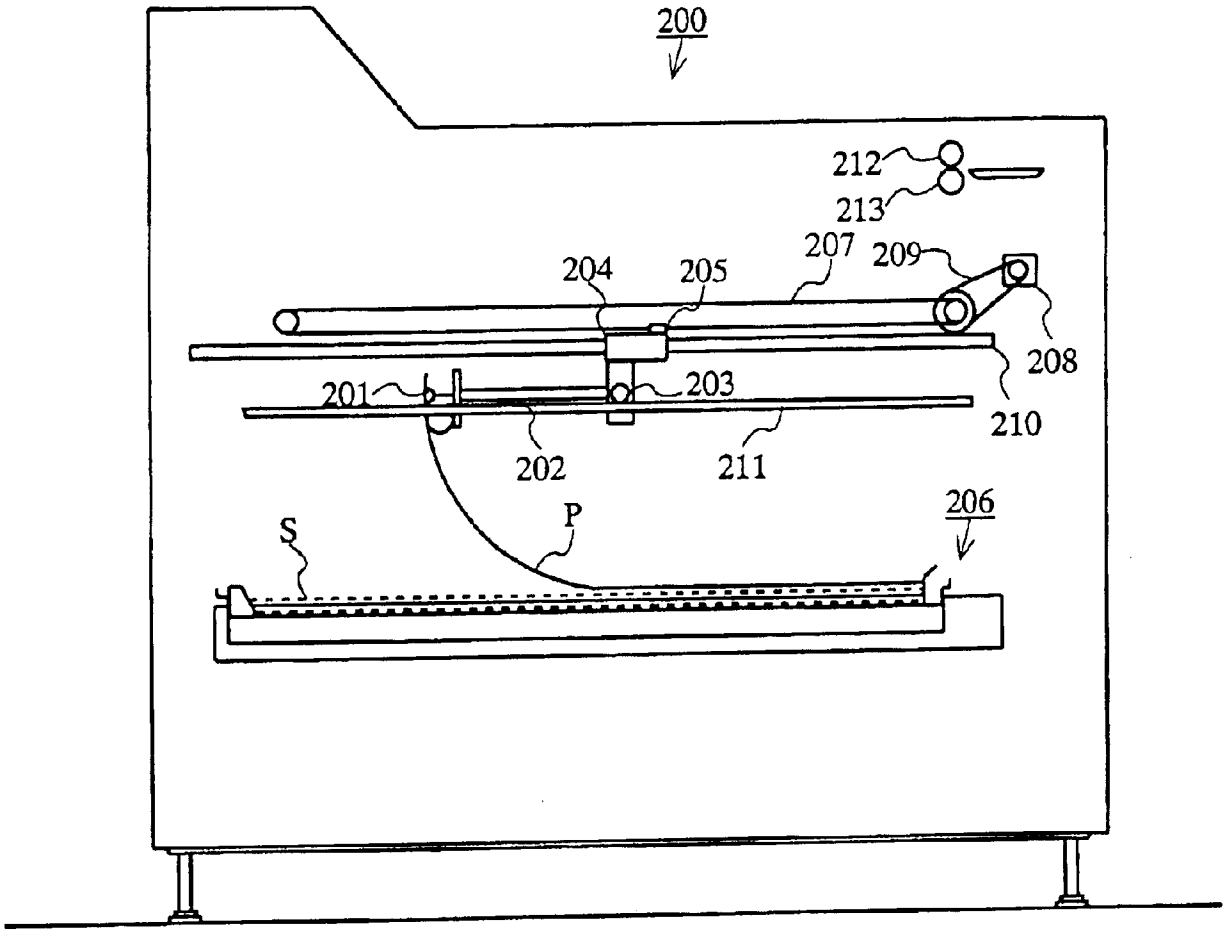
FIG. 25 PRIOR ART
FIG. 25 is still another one of the views used for explaining a series of operation of the plate transfer mechanism which is included in the conventional plate supplying apparatus 200 and used for transferring plates P from the cassette 206 toward the image recording apparatus.
Figure 26:
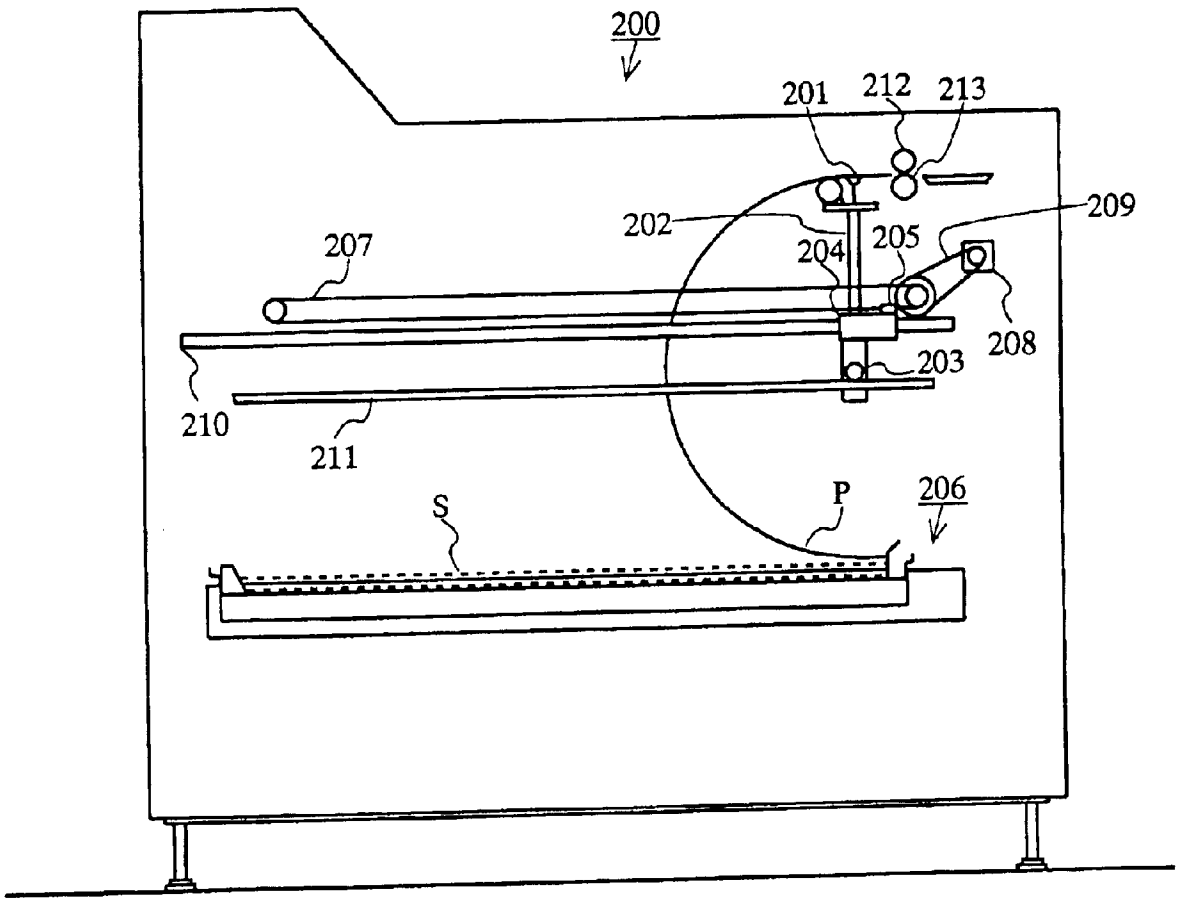
FIG. 26 PRIOR ART
FIG. 26 is still another one of the views used for explaining a series of operation of the plate transfer mechanism which is included in the conventional plate supplying apparatus 200 and used for transferring plates P from the cassette 206 toward the image recording apparatus.
Figure 27:
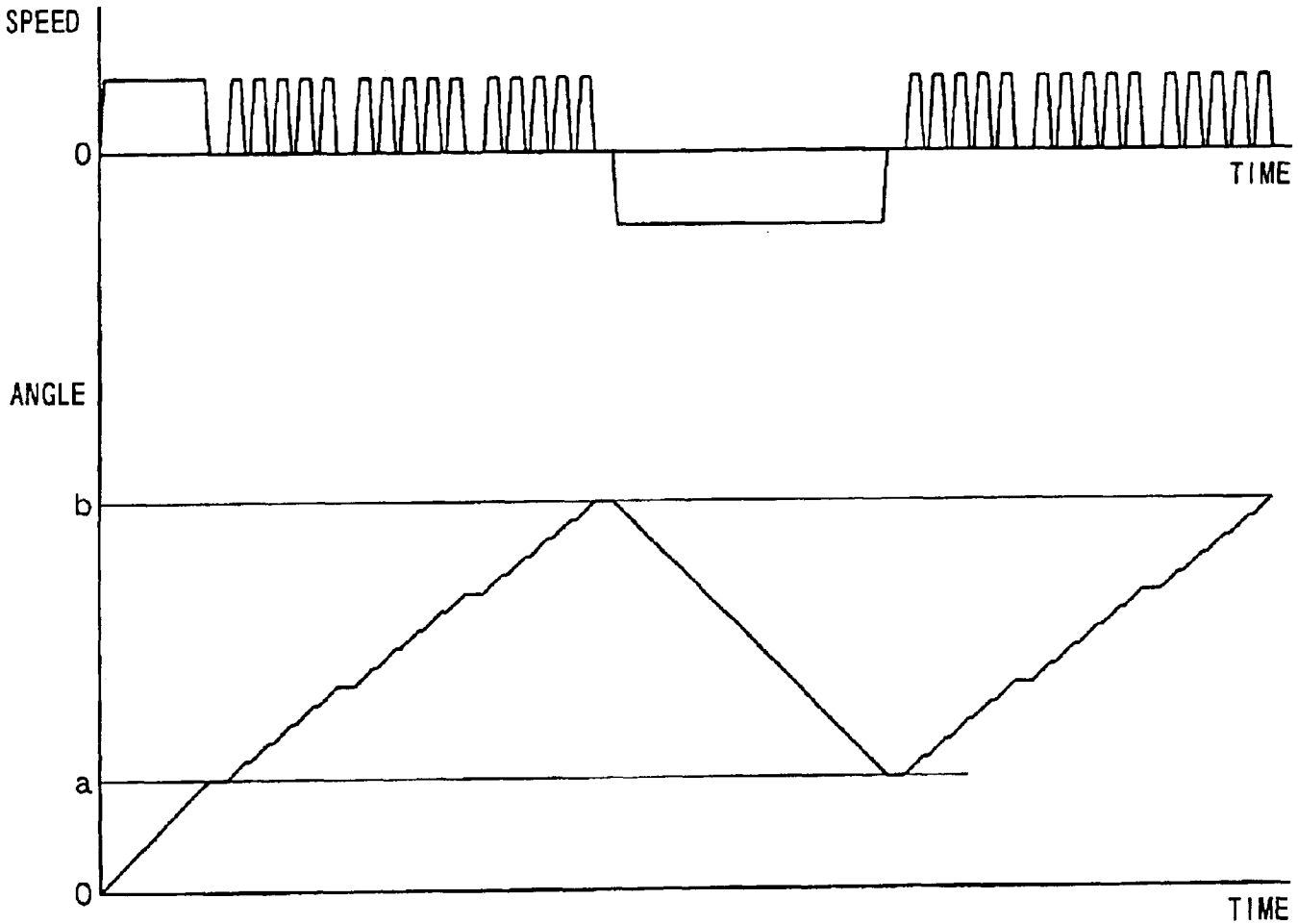
FIG. 27 PRIOR ART
FIG. 27 is a graph illustrating movements of an arm 202 illustrated in FIG. 23 swinging for a prescribed time period with respect to the speed of a traveling member 204 moving toward a transfer movement direction and the angle of the arm 202 in a transfer turn direction.

In the case where the plate transfer mechanism 400 having the above-described structure is in the state illustrated in FIG. 19, when the linear bush holder 407 is driven by the loader movement motor 440 so as to move toward a direction to the right (hereinafter, referred to as the "transfer movement direction"), as illustrated in FIGS. 20–22, the pad rods 403 pivot on the center of the coupling shaft of the speed reducer 405 in a clockwise direction (hereinafter, referred to as the "transfer turn direction"; the following description is provided on the assumption that the pad rods 403 in the state of FIG. 19 are set at an angle of 0° in the transfer turn direction).

Referring to FIGS. 19–22, a transfer operation of the plate transfer mechanism 400 and an operation of the raising and lowering mechanism 150 during the transfer operation are described. In order to transfer to the conveyer section 8 plates P from the cassette 9 having moved to the plate supply position, the electronic section 450 causes the plate transfer mechanism 400 to move to the position in which the pad rods 403 are set at an angle of 0° in the transfer turn direction. Then, the electronic section 450 controls a vacuum pump 451 and an electromagnetic valve 452 so as to cause the suction pads 401 to suck and secure a proximal end portion, which is nearer to the suction pads, of a support layer side of a plate P (state as illustrated in FIG. 19).

While maintaining the above state where the plate P is secured via suction, the electronic section 450 causes the loader transfer motor 440 to drive the linear bush holder 407 so as to move toward the transfer movement direction, thereby causing the pad rods 403 to pivot, preferably, 10° to 15° in the transfer turn direction. Then, the electronic section 450 causes the raising and lowering motor 52 included in the raising and lowering mechanism 150 to drive the plurality of shafts 55 each having the miter gears 54 on its opposite ends, thereby rotating all the ball screws 51 in a direction for lowering the cassette 9 (a direction indicated by B in FIG. 20). The rotation of the ball screws 51 causes the guiding member brackets 41 and the supporting rail brackets 42, which are engaged with the ball screws 51, to move downwards. Since the guiding member 47 and the supporting rail 48 are connected to the guiding member brackets 41 and the supporting rail brackets 42, respectively, the rotation of the ball screws 51 also causes the cassette 9 placed in the plate supply position, which is supported by the guiding member 47 and the supporting rail 48, to move downwards. The electronic section 450 stops driving of the raising and lowering motor 52 when the cassette 9 moves downwards and reaches a prescribed position (the state illustrated in FIG. 20). Note that the electronic section 450 can detect whether the cassette 9 has reached the prescribed position by controlling a rotation angle of the raising and lowering motor 52.

Then, while maintaining the above state where the suction pads 401 secure the plate P via suction, the electronic section 450 causes the plate transfer mechanism 400 to repeat gradual and reciprocal movements in the plate transfer direction, thereby gradually swinging the pad rods 403 in the plate turn direction. In this manner, the electronic section 450 performs a separating operation for peeling off a slip sheet S from the back face of the plate P. Note that the electronic section 450 may perform the separating operation by moving the pad rods 403 in a manner as described in the first embodiment.

After the completion of the separating operation, the electronic section 450 controls the plate transfer mechanism 400 so as to transfer the plate P on which the separating operation has been performed toward the conveyer section 8. The electronic section 450 causes the loader movement motor 440 to drive the linear bush holder 407 so as to move in the transfer movement direction (the state illustrated in FIG. 21). In the case of causing the loader movement motor 440 to drive the linear bush holder 407 so as to move in the transfer movement direction, while maintaining the state where the plate P is held via suction, the pad rods 403 pivot 180° in the transfer turn direction, thereby reversing a face of the plate P held via suction by the suction pads 401 (i.e., the plate P is turned over such that the support layer thereof faces downwards). Thereafter, a leading end of the plate P will be sandwiched between a pair of transfer rollers 446 and 447 for transferring the plate P to the conveyer section 8. In the transfer operation as described above, an end of the plate P opposite to the leading end is kept in contact with a positioning member 57, and therefore no friction is caused between the plate P and a slip sheet S located therebelow within the cassette 9.

After the plate P has been carried out to the conveyer section 8, the electronic section 450 causes the loader movement motor 440 and the raising and lowering motor 52 to reverse their driving directions, thereby causing the plate transfer mechanism 400 to move to the position in which the pad rods 403 are set at an angle of 0° in the transfer turn direction. The electronic section 450 also causes the cassette 9 to move up to the plate supply position. Thereafter, subsequent plate transfer is repeatedly operated.

As described above, in the autoloader section 4 (the plate supplying apparatus) of the second embodiment, when the plate transfer mechanism 400 transfers a plate P from the cassette 9, the cassette 9 is caused to move down to a prescribed position, and then the plate P is supplied to the conveyer section 8 such that its faces are reversed. Bending radius R (see FIG. 20) of the plate P when the autoloader section 4 transfers the plate P is increased as the cassette 9 moves down, and therefore bending stress applied to the plate P is reduced, resulting in reduction of a repulsive force generated in a direction of causing the plate P to be detached from the suction pads 401. That is, reduction of the repulsive force, which is a conventional problem to be solved, is realized even when the plate P is thick, and therefore it is possible to prevent a drop of the plate P during transfer.

In order to confirm the effect of preventing the drop of the plate P, the inventor has conducted desktop calculation and confirmed that in the case where the angle of the pad rods 403 in the transfer turn direction is 65°, when a descending distance of the cassette 9 is increased from 0 mm to 30 mm, the bending radius R of the plate P varies from 150 mm to 175 mm. Note that in practice, the bending radius R of the plate P obtained by the desktop calculation is influenced by the state where the plate P is placed in the cassette 9 and a transfer method used in the plate transfer mechanism 400. For example, in the plate supplying apparatus of the second embodiment, the plate P is bent during transfer, and therefore a repulsive force is generated in a direction of restoring the plate P to its planar state. The repulsive force acts in a direction of pushing a bending portion of the plate P back into the cassette 9. Moreover, between the plate P to be transferred and a slip sheet or another plate P located therebelow, there is an adhesion force generated so as to keep them in close contact with each other. The adhesion force acts in a direction of pulling the plate P to be transferred back into the cassette 9. Due to forces applied to the plate P, such as the repulsive force and the adhesion force as described above, a peeled portion of the plate P is actually smaller than an estimation obtained by the desktop calculation, and the actual value of the bending radius R is smaller than the value of the bending radius R obtained by the desktop calculation. This is noticeable especially in the case where the peeled portion of the plate P is small. In the plate supplying apparatus of the present invention, however, the cassette 9 is caused to move downwards at an early stage of plate transfer (i.e., in the state where a small portion of the plate P is raised), and therefore the bending radius R as obtained by the desktop calculation is large. Further, when compared to a conventional plate transfer apparatus, a larger portion of the plate P is peeled off at the same angle in the transfer turn direction. Accordingly, the plate supplying apparatus of the present invention reduces influences of the repulsive force and adhesion force on the bending radius R, and therefore is expected to achieve a considerable effect in preventing a drop of the plate P during transfer.

The descending distance of the cassette 9 may be set such that substantially no friction is caused between a plate P to be transferred and a slip sheet or another plate P located therebelow. For example, such setting of the descending distance is made in consideration of dimensions (the area and thickness) of the plate P to be transferred, a distance between the pivotal center and a position at which the plate P is sucked in the plate transfer mechanism, a maximum possible descending distance of the cassette 9 allowed for the plate supplying apparatus, and/or suction force of the suction pads 401. The descending distance obtained with the above considerations can be readily modified without changing the pivoting radius of the pad rods 403 within the plate transfer mechanism 400 or the suction force of the suction pads 401. That is, in the plate supplying apparatus of the present invention, the descending distance of the cassette 9 is set in accordance with the type of the plate P to be transferred, and therefore it is possible to prevent a drop of the plate P during transfer without increasing the size and cost of the apparatus and/or suction force of suction pads.

The plate supplying apparatus of the present invention has been described with respect to the case where a plurality of plates of various sizes are stored side-by-side in a cassette, and two plate transfer mechanisms each corresponding to plates on either side of the cassette are provided. However, it goes without saying that if the plate supplying apparatus is required to supply only a plate at a time, the plate supplying apparatus may include only one plate transfer mechanism.

Further, the plate supplying apparatus of the present invention has been described with respect to the case where the cassette 9 is caused to move downwards after the pad rods 403 pivots 10° to 15° in the transfer turn direction. The reason for this is that in the structure of the plate supplying apparatus used for describing the present invention, a plate P to be transferred is required to be placed with one end along a positioning member 57 provided in the cassette 9 in order to stabilize that plate P. However, in the case where such an effect of stabilizing the plate P is not required, the cassette 9 may be caused to move downwards immediately after the suction pads 401 secure the plate P via suction. In such a case, the plate P held by the suction pads 401 is turned over in parallel with the downward movement of the cassette 9, whereby it is possible to shorten the time required for taking the plate P out from the cassette 9.

As described above, the autoloader section 4 includes the slip sheet transfer mechanism 81 having movable slip sheet suction pads. The slip sheet transfer mechanism 81 secures a slip sheet via suction by the slip sheet suction pads in order to eject that slip sheet. As in the case of the plate transfer mechanism, the cassette 9 may be caused to move downwards after the slip sheet transfer mechanism 81 secures the slip sheet via suction.

Furthermore, the plate supplying apparatus of the present invention has been described with respect to the case where a proximal end portion, which is nearer to the suction pads, of a plate P present at the top of plates P stored in the cassette 9 is secured via suction, and then the plate P secured via suction is transferred such that its faces are reversed. However, the present invention is applicable to a plate supplying apparatus for transferring a plate present at the top of plates stored in a cassette or the like with at least four corners of that plate being secured via suction. In such a plate supplying apparatus, the cassette or the like may be caused to move downwards after the plate is secured via suction.

It goes without saying that when the separating operation as described in the first embodiment is realized simultaneously with the downward movement of the cassette as described in the second embodiment, effects of both the separating operation and the downward movement can be achieved.

While the invention has been described in detail, the foregoing description is in all aspects illustrative and not restrictive. It is understood that numerous other modifications and variations can be devised without departing from the scope of the invention.

What is claimed is:

1. A plate supplying apparatus for supplying a plate, which is transferred such that a portion of its faces are reversed, from a pile of plates each alternating with a slip sheet, the apparatus comprising:

the plates each having a first face facing upwards and a second face facing downwards in a storage section;

the storage section for storing the pile of plates each alternating with the slip sheet;

a plate suction section for sucking a proximal end portion of a plate present at the top of the pile of plates stored in the storage section, the proximal end portion being nearer to the plate suction section;

a base member for supporting the plate suction section;

a moving and pivoting mechanism for moving the plate suction section and the base member in a direction toward a portion of the plate opposite to the proximal end portion, while causing at least the plate suction section to pivot, thereby causing the plate sucked by the plate suction section to be transferred to a state in which at least a portion of the first and second faces are reversed so that said first face of said portion faces downwards and said second face of said portion faces upwards;

a vertical movement mechanism for causing the plate suction section to move linearly with respect to the base member for removing a slip sheet from the plate sucked by the plate suction section;

a control section for controlling movement of each of the plate suction section, the moving and pivoting mechanism, and the vertical movement mechanism; and a supplying section for supplying the plate transferred by the moving and pivoting mechanism toward another equipment device, wherein the control section controls the plate suction section so as to suck the plate, and then controls the vertical movement mechanism so as to cause the plate suction section to move linearly with respect to the base member, thereby performing a separating operation for shaking off a slip sheet adhering to a back face of the plate, and thereafter the control section controls the moving and pivoting mechanism so as to transfer toward the supplying section the plate on which the separating operation has been performed by the vertical movement mechanism.

2. The plate supplying apparatus according to claim 1, wherein the control section controls the plate suction section so as to suck the plate, and then controls the vertical movement mechanism so as to cause the plate suction section to repeat a slight ascent or descent and a pause, thereby shaking off the slip sheet adhering to the back face of the plate.

3. The plate supplying apparatus according to claim 1, wherein the control section controls the plate suction section so as to suck the plate, and then controls the moving and pivoting mechanism so as to cause the plate suction section and the base member to pivot a prescribed angle, and thereafter the control section controls the vertical movement mechanism so as to cause the plate suction section to move up and down, thereby shaking off the slip sheet adhering to the back face of the plate.

4. The plate supplying apparatus according to claim 1, wherein the control section controls the vertical movement mechanism so as to shorten a distance between the base member and a position at which the plate suction section sucks the plate, and then controls the moving and pivoting mechanism so as to cause the plate suction section and the base member to move while pivoting, thereby transferring the plate.

5. The plate supplying apparatus according to claim 4, wherein the control section controls the vertical movement mechanism so as to cause the plate suction section to further move up or down such that the proximal end of the plate, which has been transferred by the moving and pivoting mechanism such that its faces are reversed, is aligned with the supplying section.

6. The plate supplying apparatus according to claim 1, wherein the control section controls the vertical movement mechanism so as to adjust, in accordance with a vertical position of the plate present at the top of the pile of plates stored in the storage section within the plate supplying apparatus, a distance between the base member and a position at which the plate suction section sucks the plate present at the top of the pile of plates, and after the adjustment of the distance, the control section controls the plate suction section so as to suck the proximal end portion of the plate present at the top of the pile of plates.

7. The plate supplying apparatus according to claim 1, wherein the control section controls the vertical movement mechanism so as to adjust, in accordance with a remaining amount of the pile of plates stored in the storage section, a distance between the base member and a position at which the plate suction section sucks the plate present at the top of the pile of plates, and then the control section controls the plate suction section so as to suck the proximal end portion of the plate present at the top of the pile of plates.

8. The plate supplying apparatus according to claim 1, wherein:

the storage section stores a plurality of piles of plates side-by-side, each plate alternating with a slip sheet;

the plate supplying apparatus comprises a plurality of plate suction sections each provided for a corresponding one of the piles of plates stored in the storage section;

the plate supplying apparatus comprises a plurality of vertical movement mechanisms each provided for a corresponding one of the plate suction sections; and the control section controls each of the vertical movement mechanisms so as to adjust, in accordance with a remaining amount of each pile of plates stored in the storage section, a distance between the base member and a position at which each of the plate suction sections sucks a plate present at the top of a corresponding one of the piles of plates, and then the control section controls each of the plate suction sections so as to suck a proximal end portion of the plate present at the top of the corresponding one of the piles of plates.

9. The plate supplying apparatus according to claim 1, wherein the vertical movement mechanism includes:

a rod having the plate suction section provided at an end portion thereof; and a rod expansion and contraction mechanism for moving the rod along a longitudinal direction of the rod with respect to the base member.

10. A plate supplying apparatus for supplying a plate, which is transferred such that a portion of its faces are reversed, from a pile of plates, the apparatus comprising:

the plates each having a first face facing upwards and a second face facing downwards in a storage section;

the storage section for storing the pile of plates;

a plate suction section for sucking a proximal end portion of a plate present at the top of the pile of plates stored in the storage section, the proximal end portion being nearer to the plate suction section;

a base member for supporting the plate suction section;

a moving and pivoting mechanism for moving the plate suction section and the base member in a direction toward a portion of the plate opposite to the proximal end portion, while causing at least the plate suction section to pivot, thereby causing the plate sucked by the plate suction section to be transferred to a state in which at least a portion of the first and second faces are reversed so that said first face of said portion faces downwards and said second face of said portion faces upwards;

a vertical movement mechanism for causing the plate suction section to move linearly with respect to the base member for removing another plate from the plate sucked by the plate suction section;

a control section for controlling movement of each of the plate suction section, the moving and pivoting mechanism, and the vertical movement mechanism; and a supplying section for supplying the plate transferred by the moving and pivoting mechanism toward another equipment device, wherein the control section controls the plate suction section so as to suck the plate, and then controls the vertical movement mechanism so as to cause the plate suction section to move linearly with respect to the base member, thereby performing a separating operation for shaking off another plate adhering to a back face of the plate sucked by the plate suction section, and thereafter the control section controls the moving and pivoting mechanism so as to transfer toward the supplying section the plate on which the separating operation has been performed by the vertical movement mechanism.

* * * * *